US012484747B2

(12) United States Patent
Hwang et al.

(10) Patent No.: US 12,484,747 B2
(45) Date of Patent: Dec. 2, 2025

(54) VACUUM CLEANER

(71) Applicant: LG ELECTRONICS INC., Seoul (KR)

(72) Inventors: Phil Jae Hwang, Seoul (KR); Chung Jae Ryu, Seoul (KR); Chi Wan Kim, Seoul (KR); Gyoung Min Lee, Seoul (KR); Yun Bo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 308 days.

(21) Appl. No.: 17/777,461

(22) PCT Filed: Jun. 2, 2020

(86) PCT No.: PCT/KR2020/007127
§ 371 (c)(1),
(2) Date: May 17, 2022

(87) PCT Pub. No.: WO2021/112354
PCT Pub. Date: Jun. 10, 2021

(65) Prior Publication Data

US 2022/0400916 A1 Dec. 22, 2022

(30) Foreign Application Priority Data

Dec. 3, 2019 (KR) ..... 10-2019-0159191

(51) Int. Cl.
*A47L 9/04* (2006.01)
*A46B 13/00* (2006.01)
(Continued)

(52) U.S. Cl.
CPC ..... *A47L 9/0477* (2013.01); *A46B 13/006* (2013.01); *A46B 13/02* (2013.01);
(Continued)

(58) Field of Classification Search
CPC ..... A47L 9/0477; A47L 9/04; A47L 9/0411; A47L 5/26; A47L 9/0444; A47L 9/0461;
(Continued)

(56) References Cited

U.S. PATENT DOCUMENTS

2009/0089958 A1 4/2009 Dant et al.
2021/0251443 A1* 8/2021 Perry ..... A47L 9/0444

FOREIGN PATENT DOCUMENTS

CN 204654812 9/2015
CN 107397506 11/2017
(Continued)

OTHER PUBLICATIONS

CN-209574555-U espacenet (Year: 2024).*
(Continued)

*Primary Examiner* — Monica S Carter
*Assistant Examiner* — Kent N Shum
(74) *Attorney, Agent, or Firm* — Fish & Richardson P.C.

(57) ABSTRACT

A vacuum cleaner includes a main body and a suction nozzle. The suction nozzle includes a housing, a driver, a rotating brush, and a detachable cover. A pressing button is mounted in the housing. The detachable cover is rotated about the rotational axis of the rotating brush to be mounted in the housing. The pressing button selectively blocks rotation of the detachable cover.

15 Claims, 28 Drawing Sheets

(51) Int. Cl.
*A46B 13/02* (2006.01)
*A47L 11/19* (2006.01)

(52) U.S. Cl.
CPC ..... *A47L 9/0411* (2013.01); *A47L 11/19* (2013.01); *A46B 2200/3033* (2013.01)

(58) Field of Classification Search
CPC ..... A47L 11/16; A47L 11/18; A47L 11/19; A47L 11/202; A46B 13/006; A46B 13/00; A46B 13/02; A46B 2200/3033; A46B 13/001
USPC ..... 15/383, 363, 389, 390, 391, 392
See application file for complete search history.

(56) References Cited

FOREIGN PATENT DOCUMENTS

| | | | | |
|---|---|---|---|---|
| CN | 108601495 | | | 9/2018 |
| CN | 108937719 | | | 12/2018 |
| CN | 208573585 | | | 3/2019 |
| CN | 208573585 | U | * | 3/2019 |
| CN | 209574555 | U | * | 11/2019 |
| EP | 2768371 | | | 3/2016 |
| JP | 2005312589 | | | 11/2005 |
| JP | 2017121468 | | | 7/2017 |
| KR | 20170027418 | | | 3/2017 |
| KR | 20170090708 | | | 8/2017 |
| KR | 20190080855 | | | 7/2019 |
| KR | 20190080855 | A | * | 7/2019 |
| WO | WO2019186089 | | | 10/2019 |

OTHER PUBLICATIONS

KR-20190080855-A espacenet (Year: 2024).*
CN-208573585-U espacenet (Year: 2024).*
Office Action in Chinese Appln. No. 202080084091.5, mailed on Feb. 3, 2023, 27 pages (with Machine translation).
Extended European Search Report in European Appln. No. 20896490, mailed on Mar. 17, 8 pages.

* cited by examiner

VACUUM CLEANER

CROSS-REFERENCE TO RELATED APPLICATIONS

This application is a National Stage application under 35 U.S.C. § 371 of International Application No. PCT/KR2020/007127, filed on Jun. 2, 2020, which claims the benefit of Korean Patent Application No. 10-2019-0159191, filed on Dec. 3, 2019. The disclosures of the prior applications are incorporated by reference in their entirety.

BACKGROUND

1. Technical Field

The present disclosure relates to a vacuum cleaner and, more particularly, to a vacuum cleaner capable of sucking up dust with a rotating brush even from a smooth floor.

2. Description of Related Art

Vacuum cleaners have different cleaning capabilities depending on the type of mounted brush.

For efficient cleaning of a rough carpet, a stiff plastic brush for carpets is suitable.

For efficient cleaning of a smooth floor, a floor brush made of soft flannel is appropriate.

When such a floor brush made of soft flannel is used, scratching on floors that could be caused by a stiff brush can be prevented. In addition, as the flannel brush is rotated for cleaning, even fine dust on the floor can be lifted into the air and sucked up by the vacuum cleaner.

In relation to this, Korean Patent Application Publication No. 2019-0080855 (hereinafter referred to as "related art 1") discloses a vacuum cleaner. The vacuum cleaner of related art 1 includes a main body and a suction nozzle. The suction nozzle includes a housing, a rotating cleaner, a driver, and a rotating support.

The housing includes a first side surface cover and a second side surface cover. The first side surface cover and the second side surface cover are coupled to both side surfaces of a chamber. The rotating support unit is provided in the second side surface cover. The rotating support unit, positioned in an opposite side of the driver, rotatably supports the rotating cleaning unit.

The rotating cleaning unit moves the dust on the surface of the floor in the backward direction using multiple bristles. Dust and debris, such as hair, can easily stick to the bristles of the rotating cleaning unit. Thus, the rotating cleaning unit has to be frequently cleaned by the user. Accordingly, the coupling structure between the second side surface cover and the main body should be simple. A coupling force is formed between the second side surface cover and the main body by a locking structure such as a hook.

When the vacuum cleaner is used, the rotating cleaning unit rotates and generates friction with the floor. The surface of the floor may be made of a synthetic resin or wood. Generally, a user cleans the floor by moving the suction nozzle in front and rear directions. When the direction of the suction nozzle is changed, the suction nozzle can move in left and right directions. Or, when the direction of the suction nozzle is changed, the suction nozzle can move in the front and rear directions and in an inclined direction.

When the vacuum cleaner is used, a reaction force and a friction force of the floor continuously act on the rotating cleaning unit. When the direction of the suction nozzle is changed, the reaction force and the friction force of the floor may be applied to the rotating cleaning unit in the axial direction thereof. The coupling force between the second side surface cover and the main body must be sufficiently greater than the axial-directional force applied to the rotating cleaning unit.

However, there is a limit in increasing the coupling force between the second side surface cover and the main body using a locking structure such as a hook. In addition, if the coupling force between the second side surface cover and the main body is increased using a fastening member, such as a bolt or the like, the user would have difficulties in decoupling the rotating cleaning unit and the main body.

Related Art 1: Korean Patent Publication No. 2019-0080855 (Jul. 1, 2019)

SUMMARY OF THE INVENTION

An aspect of the present disclosure is directed to providing a vacuum cleaner in which a detachable cover may be easily coupled to and decoupled from a side surface of a housing.

Another aspect of the present disclosure is directed to providing a vacuum cleaner in which the detachable cover and the housing form a coupling force that is sufficiently greater than an axial-directional force acting on a rotating brush.

Yet another aspect of the present disclosure is directed to providing a vacuum cleaner in which the detachable cover may be easily decoupled from the housing even when no special tool is provided.

In a vacuum cleaner according to an embodiment of the present disclosure, a pressing button may selectively block rotation of a detachable cover. Accordingly, even when no special tool is provided, the detachable cover can easily be coupled to and decoupled from the housing.

The vacuum cleaner according to an embodiment of the present disclosure may include a main body and a suction nozzle.

The main body may generate a difference in air pressure. An air blower may be provided inside the main body.

The suction nozzle may suck up dust from a floor by using the difference in air pressure.

The suction nozzle may include a housing, a driver, a rotating brush, and the detachable cover.

An inlet through which the dust moves into the main body may be formed in the housing. The inlet may be formed behind the housing. The inlet may be formed in a cylindrical shape.

When the air blower generates a difference in air pressure, dust and debris on the floor may be moved into the main body through an inlet of the suction nozzle.

The driver may be installed in the housing. The driver may rotate a first shaft member. The driver may include a motor and a transmission.

The motor may generate a rotational force. The motor may be provided as a brushless direct current (BLDC) motor. The transmission may transfer the rotational motion of the motor to the first shaft member.

The rotating brush may rotate while engaging the first shaft member.

The rotating brush may include a body, a brush member, and a second shaft member.

The body may be formed in a hollow cylindrical shape. A central axis of the body may act as a central axis of the rotating brush. The body may form a uniform rotational inertia along the circumferential direction of the body.

The brush member may be attached to an outer surface of the body so as to come into contact with the floor. The brush member may include a plurality of bristles. When the body rotates, the plurality of bristles may move dust and debris on the floor in a rear direction. The plurality of bristles may include fiber bristles and metal bristles.

The second shaft member may be provided in an opening at one side of the body.

The second shaft member may engage the first shaft member. The first shaft member may be inserted into the second shaft member to transfer rotational motion to the second shaft member. A rotational axis of the first shaft member and a rotational axis of the rotating brush may be on the same line.

The detachable cover may rotatably support the rotating brush. The body may be rotatably connected to the detachable cover by means of a third shaft member. The detachable cover may be rotated about the rotational axis of the rotating brush to be detachably coupled to the housing.

A plurality of first protrusions may be formed in the detachable cover. A protruding rib and a hub may be formed on an inner surface of the detachable cover. The protruding rib may be formed along a circumferential direction of the hub. The first protrusions may be formed in the protruding rib.

A guide rail may be formed in the housing along a circumferential direction thereof.

The guide rail may guide rotation of the first protrusions about the rotational axis. The first protrusions may be guided to an outer surface of the guide rail to rotate in both directions about the rotational axis.

A plurality of first walls may be formed in the guide rail. The first walls may protrude from the outer surface of the guide rail.

The first walls may block movement of the first protrusions in a direction of the rotational axis. Accordingly, the detachable cover and the housing may form a coupling force that is sufficiently greater than an axial-directional force acting on the rotating brush.

A plurality of second walls may be formed in the guide rail. The second walls may protrude from the outer surface of the guide rail.

The second walls may block rotation of the first protrusions about the rotational axis.

A second protrusion may be formed in the housing.

A guide groove may be formed in the detachable cover along a circumferential direction thereof.

An inner surface of the guide groove may guide rotation of the second protrusion about the rotational axis.

A pressing button may be formed in the housing.

A third protrusion may be formed in the detachable cover.

The pressing button may include a button portion and a first blocking portion.

A first mounting groove into which the button portion is inserted may be formed in the housing. The user may push the button portion.

The first blocking portion may extend from the button portion. The first blocking portion may block rotation of the third protrusion about the rotational axis.

When the user pushes the button portion, the first blocking portion may deviate from a rotational path of the third protrusion. Accordingly, the detachable cover can be easily coupled to and decoupled from the housing simply by the user pushing the button portion.

The button portion may be rotatably mounted in the housing.

A pair of shaft portions may be formed in the button portion. A pair of shaft grooves may be formed on an inner surface of the first mounting groove. The shaft portions may be inserted into the shaft grooves. The button portion may be rotated about the shaft portions that are inserted into the shaft grooves.

A second mounting groove may be formed in the housing. The first blocking portion may rotate about the shaft portions within the second mounting groove.

The pressing button may include an elastic member. The pressing button may be interposed between the button portion and the housing.

The elastic member may generate a force that pushes the button portion outwards between the shaft portion and the first blocking portion. The first blocking portion may be positioned in a rotational path of the third protrusion by an elastic force of the elastic member.

A fourth protrusion may be formed in the detachable cover.

The pressing button may include a second blocking portion. The second blocking portion may extend from the button portion. The second blocking portion may block movement of the fourth protrusion in the direction of the rotational axis.

Meanwhile, the vacuum cleaner according to another embodiment of the present disclosure may include a main body and a suction nozzle.

The main body may generate a difference in air pressure. An air blower may be provided within the main body.

The suction nozzle may suck up dust from a floor by using the difference in air pressure. When the air blower generates a difference in air pressure, dust and debris on the floor may be moved into the main body through an inlet of the suction nozzle.

The suction nozzle may include a housing, a driver, and a detachable cover.

The housing may roll on the floor by means of a plurality of wheels. A pressing button may be mounted in the housing.

The driver may be installed in the housing. The driver may rotate the rotating brush.

The driver may include the motor and a transmission. The motor may generate a rotational force. The motor may be provided as a brushless direct current (BLDC) motor. The transmission may transfer the rotational motion of the motor to the rotating brush.

The detachable cover may rotatably support the rotating brush. The body may be rotatably connected to the detachable cover by means of a third shaft member. The detachable cover may be rotated about the rotational axis of the rotating brush to be detachably coupled to the housing. Accordingly, the detachable cover may easily be coupled to and decoupled from the side surface of the housing.

The pressing button may selectively block rotation of the detachable cover. Accordingly, even when no special tool is provided, the detachable cover can easily be coupled to and decoupled from the housing.

According to embodiments of the present disclosure, when the first protrusions are rotated along the guide rail about the rotational axis of the rotating brush, the first walls may block movement of the first protrusions in the direction of the rotational axis, and the first blocking portion extending from the button portion may block rotation of the third protrusion about the rotational axis, such that a coupling force between the detachable cover and the housing is formed or removed by means of the rotation of the detachable cover.

According to embodiments of the present disclosure, as the first walls, which are disposed along the circumferential direction of the rotational axis of the rotating brush, block movement of the first protrusions in the direction of the rotational axis, the first walls may uniformly distribute an axial-directional force acting on the rotating brush around the rotational axis of the rotating brush, such that decoupling and shaking of the detachable cover, caused by the axial-directional force acting on the rotating brush, may be blocked.

According to embodiments of the present disclosure, as the pressing button selectively blocks rotation of the detachable cover, even an elderly person or a child, who would have difficulties in using a tool, such as a screwdriver, may easily decouple the detachable cover from the housing through a relatively simple motion.

BRIEF DESCRIPTION OF THE DRAWINGS

The foregoing and other aspects, features, and advantages of the invention, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

DESCRIPTION OF SYMBOLS

Figure 1:
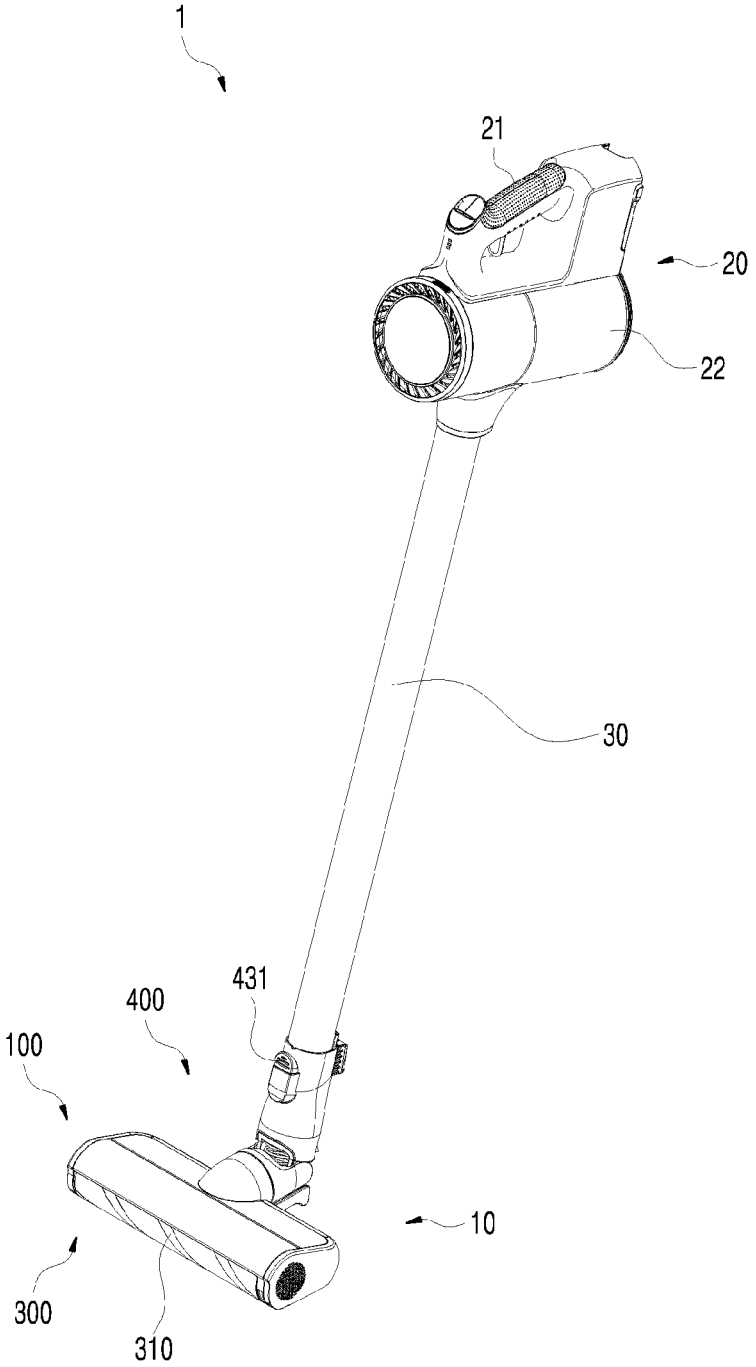
FIG. 1 is a perspective view of a vacuum cleaner according to an embodiment of the present disclosure.

1: VACUUM CLEANER
20: MAIN BODY
21: HANDLE
22: DUST BOX
30: EXTENSION PIPE
10: SUCTION NOZZLE
100: HOUSING
101: SUCTION SPACE
102: ISOLATED SPACE
110: MAIN HOUSING
110A: FRONT PORTION
110H: HOLE
111: INLET
111A: SEVENTH BOUNDARY SURFACE
112: GUIDE RAIL
112A: FIRST WALL
112B: SECOND WALL
113: SECOND PROTRUSION
120: LOWER HOUSING

121: FIRST LOWER HOUSING
121A: FIRST WALL SURFACE
121B: SECOND WALL SURFACE
122: SECOND LOWER HOUSING
130: MOUNTING HOUSING
131: COVER PORTION
132: MOUNTING PORTION
133: INTERPOSITION PORTION
133A: FOURTH BOUNDARY SURFACE
133B: SIXTH BOUNDARY SURFACE
140: SUPPORT HOUSING
141: PRESSING BUTTON
141A: BUTTON PORTION
141B: ELASTIC MEMBER
141C: FIRST BLOCKING PORTION
141D: SECOND BLOCKING PORTION
141E: SHAFT PORTION
141H1: FIRST MOUNTING GROOVE
141H2: SECOND MOUNTING GROOVE
141H3: THIRD MOUNTING GROOVE
141H4: SHAFT GROOVE
150: SIDE SURFACE COVER
200: DRIVER
210: BRACKET
220: MOTOR
230: TRANSMISSION
231: FIRST BELT TRANSMISSION
231A: DRIVING PULLEY
231B: FIRST MIDDLE PULLEY
231C: FIRST BELT
232: SECOND BELT TRANSMISSION
232A: DRIVEN PULLEY
232B: SECOND MIDDLE PULLEY
232C: SECOND BELT
232D: FIRST SHAFT MEMBER
232DA: HUB
232DB: FIRST TRANSFER PORTION
232D1: FIRST SURFACE
232D2: THIRD SURFACE
232D3: FIFTH SURFACE
C1: FIRST CONTACT SURFACE
C2: SECOND CONTACT SURFACE
300: BRUSH MODULE
310: ROTATING BRUSH
311: BODY
311A: PROTRUDING PORTION
312: BRUSH MEMBER
313: SECOND SHAFT MEMBER
313A: SHAFT BODY
313B: SECOND TRANSFER PORTION
313B1: SECOND SURFACE
313B2: FOURTH SURFACE
313A1: SIXTH SURFACE
313B3: SEVENTH SURFACE
314: THIRD SHAFT MEMBER
320: DETACHABLE COVER
321: COVER BODY
322: HUB
323: PROTRUDING RIB
324: FIRST PROTRUSION
325: GUIDE GROOVE
326: THIRD PROTRUSION
326A: INCLINED SURFACE
326B: CATCHING SURFACE
327: FOURTH PROTRUSION
400: CONNECTOR
401: PASSAGE
410: INSERTION PORTION
411: CATCH HOLE
420: FIRST CONNECTION PORTION
421: SECOND BOUNDARY SURFACE
430: SECOND CONNECTION PORTION
431: RELEASE BUTTON
432: ENGAGING PORTION
440: COUPLING PART
441: PIPE PORTION
441A: CATCH PORTION
442: PROTRUSION PORTION
442A: FIRST BOUNDARY SURFACE
442B: THIRD BOUNDARY SURFACE
442C: FIFTH BOUNDARY SURFACE
442D: EIGHTH BOUNDARY SURFACE
443: SPACING PROTRUSION PORTION
450: ELASTIC PIPE
451: ELASTIC TUBE
452: COIL SPRING

DETAILED DESCRIPTION

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

In relation to describing the present disclosure, when the detailed description of the relevant known technology is determined to unnecessarily obscure the gist of the present disclosure, the detailed description may be omitted.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms "connected" and "coupled" are not restricted to physical or mechanical connections or couplings, and can include electrical connections or couplings, whether direct or indirect. The connection can be such that the objects are permanently connected or releasably connected. The term "communicatively coupled" is defined as connected, either directly or indirectly through intervening components, and the connections are not necessarily limited to physical connections, but are connections that accommodate the transfer of data, fluids, or other matter between the so-described components.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

Hereinafter, preferable exemplary embodiments of the present disclosure will be described in detail referring to the attached drawings. In the following description, known functions or features will not be described in order to clarify the gist of the present disclosure.

FIG. 1 is a perspective view of a vacuum cleaner 1 according to an embodiment of the present disclosure.

As illustrated in FIG. 1, the vacuum cleaner 1 according to an embodiment of the present disclosure may include a main body 20 and a suction nozzle 10.

The suction nozzle 10 may be connected to the main body 20 through an extension pipe 30. The suction nozzle 10 may be directly connected to the main body 20. A user may grip a handle 21 formed in the main body 20 and move the suction nozzle 10 back and forth on a floor.

The main body 20 may generate a difference in air pressure. Inside the main body 20, an air blower may be provided. When the air blower generates a difference in air pressure, dust and debris on the floor may be moved into the main body 20 through an inlet 111 of the suction nozzle 10 and the extension pipe 30.

Inside the main body 20, a centrifugal dust collector may be provided. The dust and debris may be received in a dust box 22.

Figure 2:
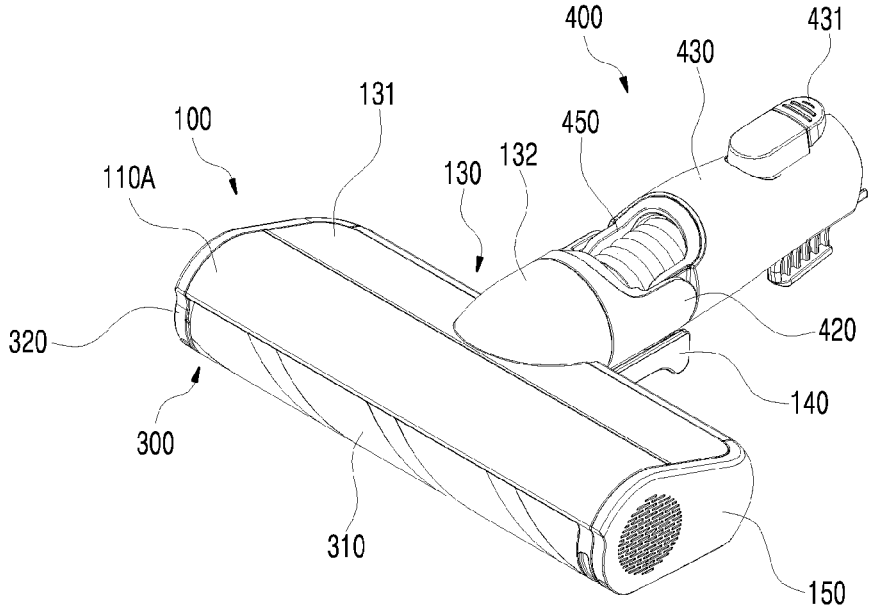
FIG. 2 is a perspective view of a suction nozzle of the vacuum cleaner of FIG. 1 seen from above.
Figure 3:
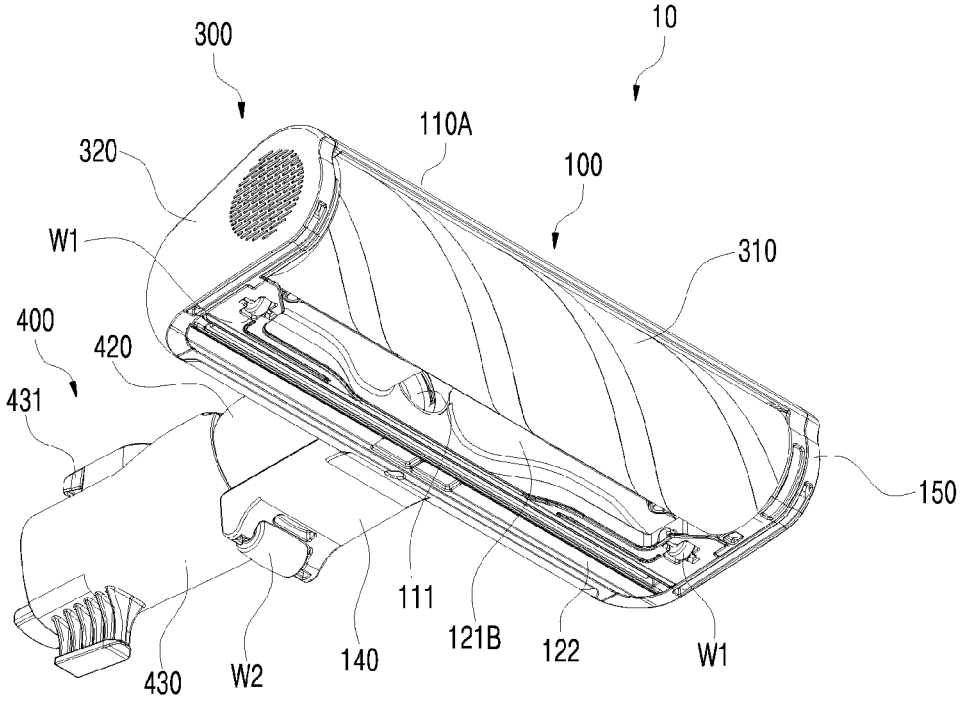
FIG. 3 is a perspective view of the suction nozzle of the vacuum cleaner of FIG. 1 seen from below.
Figure 4:
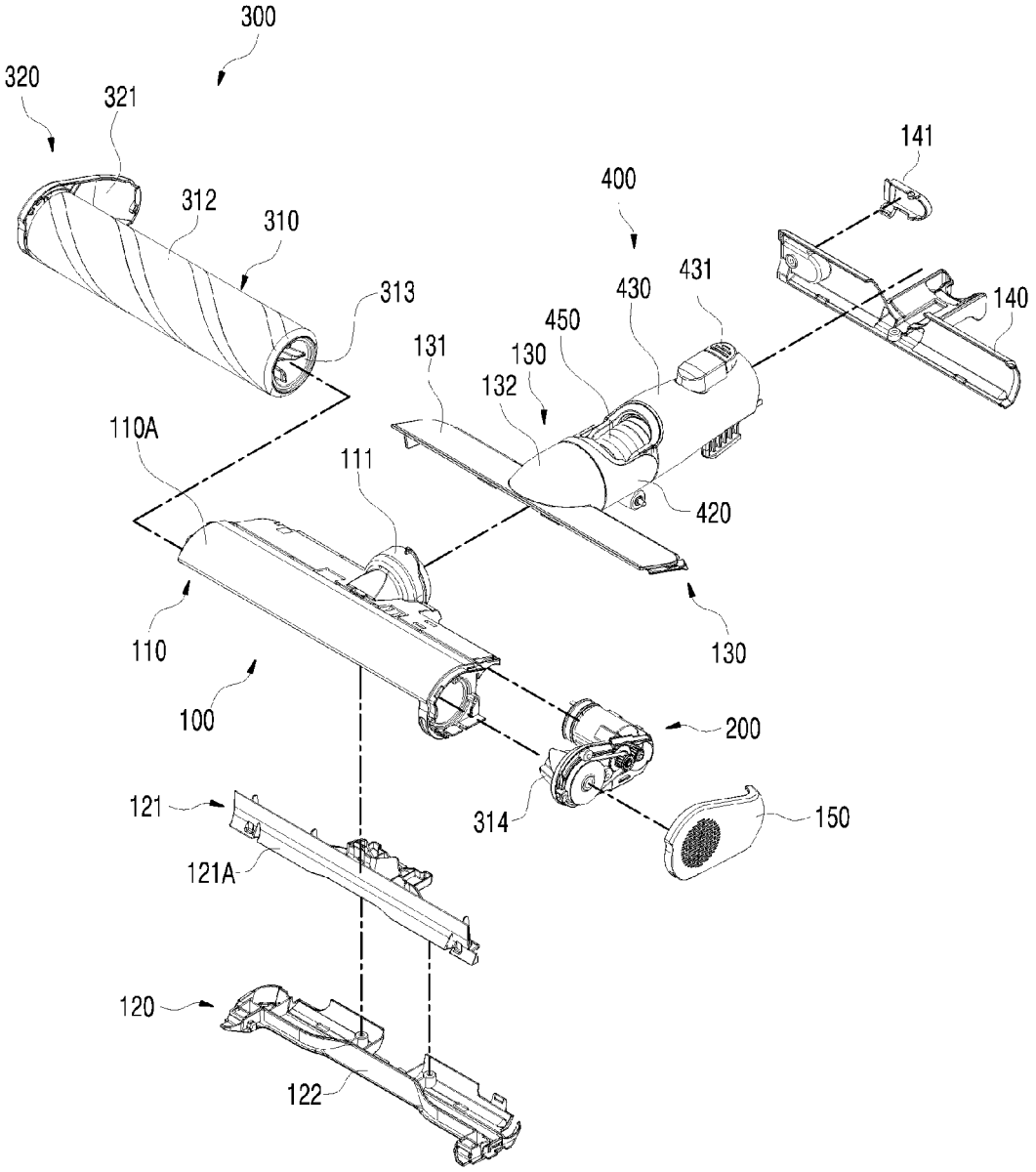
FIG. 4 is an exploded perspective view of the suction nozzle of FIG. 2.

FIG. 2 is a perspective view of the suction nozzle 10 of the vacuum cleaner 1 of FIG. 1 seen from above. FIG. 3 is a perspective view of the suction nozzle 10 of the vacuum cleaner 1 of FIG. 1 seen from below. FIG. 4 is an exploded perspective view of the suction nozzle 10 of FIG. 2.

The suction nozzle 10 may suck up dust on the floor by using a difference in air pressure. The suction nozzle 10 may include a housing 100, a driver 200, a brush module 300, and a connector 400.

Hereinafter, for easy understanding of the present disclosure, a side of the suction nozzle 10 where a rotating brush 310 is positioned will be referred to as the front of the suction nozzle 10, and a side of the suction nozzle 10 where the connector 400 is positioned will be referred to as the rear or back of the suction nozzle 10.

The suction nozzle 10 may be assembled in the following order. First of all, the connector 400 may be assembled. Secondly, the connector 400 may be assembled with a mounting housing 130.

The mounting housing 130 may be rotatably mounted in the connector 400. Then, the driver 200 may be coupled to one side of a main housing 110.

Thereafter, the mounting housing 130 may be coupled to an upper portion of the main housing 110. Next, a lower housing 120 may be coupled to a lower portion of the main housing 110. Then, a support housing 140 may be coupled to a lower portion of the main housing 110.

Thereafter, a pressing button 141 may be mounted in the support housing 140. Next, a side surface cover 150 may be coupled to one side of the main housing 110.

Finally, a first shaft member 232D may be inserted into a second shaft member 313 of a rotating brush 310, and a detachable cover 320 may be detachably coupled to the other side of the main housing 110. Then, the assembly of the suction nozzle 10 may be completed.

Figure 5:
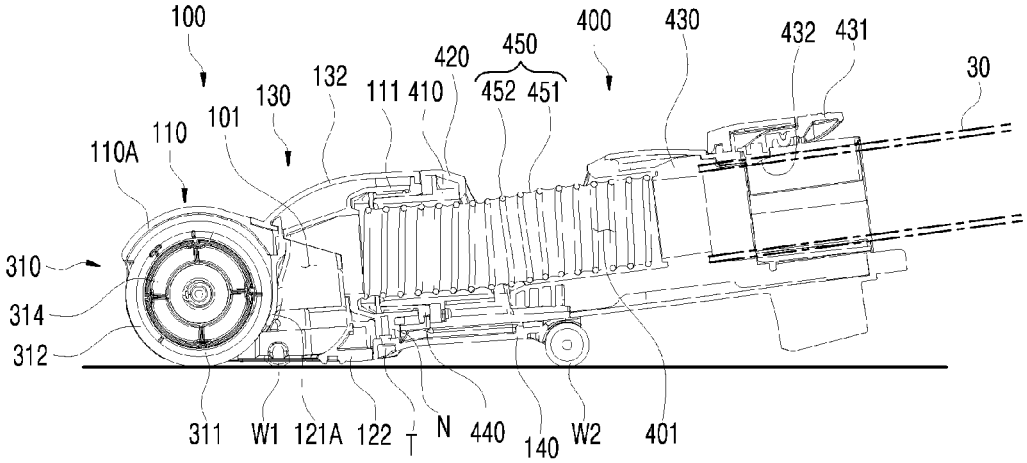
FIG. 5 is a cross-sectional view of the suction nozzle of FIG. 2.

FIG. 5 is a cross-sectional view of the suction nozzle 10 of FIG. 2.

As illustrated in FIGS. 4 and 5, the housing 100 may guide dust and debris on the floor to a passage 401 of the connector 400.

The housing 100 may include a main housing 110, a lower housing 120, a mounting housing 130, and a support housing 140.

The main housing 110 may form an inlet 111 through which dust moves to the main body 20. The inlet 111 may be formed behind the main housing 110. The inlet 111 may be formed in a cylindrical shape. A rotating brush 310 may be mounted in front of the main housing 110.

A front of the main housing 110 (hereinafter referred to as a "front portion 110A") may be formed to cover an upper portion of the rotating brush 310. The front portion 110A may form a wall that extends in a circumferential direction of a rotational axis of the rotating brush 310. The front portion 110A may be spaced apart from the upper portion of the rotating brush 310 by a certain distance.

The rotating brush 310 may be rotated by the driver 200. The rotating brush 310 may push dust and debris on the floor to behind the rotating brush 310. The dust and debris pushed to behind the rotating brush 310 may easily enter the inlet 111. The main housing 110, positioned between the rotating brush 310 and the inlet 111, may cover the surface of the floor.

Between the rotating brush 310 and the inlet 111, the housing 100 may form a space (hereinafter referred to as a "suction space 101") between the housing 100 and the floor. Excluding a gap formed between the housing 100 and the floor, the suction space 101 may be isolated from outside. The dust and debris in the suction space 101 may enter the passage 401 through the inlet 111.

As illustrated in FIGS. 4 and 5, the lower housing 120, with the main housing 110, may form the suction space 101. The lower housing 120 may include a first lower housing 121 and a second lower housing 122.

The first lower housing 121 and the second lower housing 122, positioned between the rotating brush 310 and the inlet 111, may form a wall which guides the dust and debris in the suction space 101 towards the inlet 111.

The lower housing 120, with the support housing 140, may be coupled to a lower portion of the main housing 110 by means of a bolt. In the main housing 110, a fastening portion (N) to which a bolt is screw-coupled may be formed. An insertion portion (T) into which a bolt is inserted may be formed in the first lower housing 121, the second lower housing 122, and the support housing 140.

The first lower housing 121 may include a first wall surface 121A and a second wall surface 121B.

An upper portion of the first wall surface 121A may be disposed in close contact with the front portion 110A. A front surface of the first wall surface 121A may come into contact with the brush member 312. When the brush member 312 rotates, dust and debris adhering to the brush member 312 may bump against a lower portion of the first wall surface 121A to thereby come off the brush member 312.

The second wall surface 121B and the second lower housing 122, positioned between left and right sides of the inlet 111 and the floor, may form a wall which guides dust and debris in the suction space 101 towards the inlet 111. A pair of first wheels (W1) may be mounted in the second lower housing 122.

Figure 6:
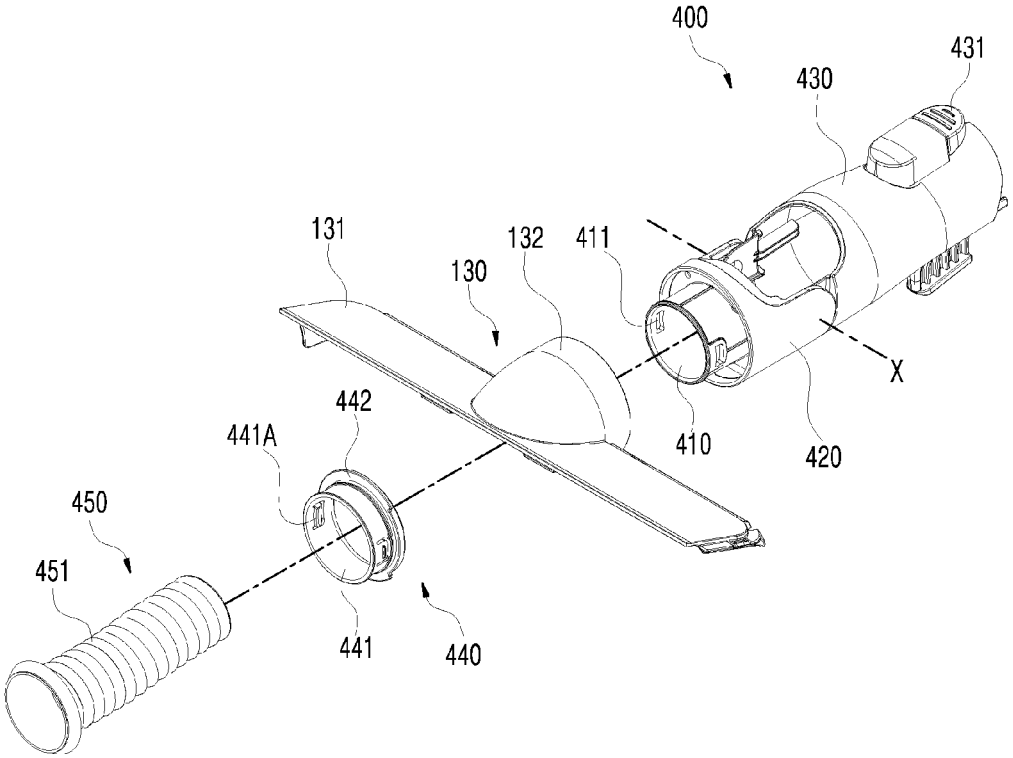
FIG. 6 is an exploded perspective view of a mounting housing and a connector of the suction nozzle of FIG. 4 seen from above.
Figure 7:
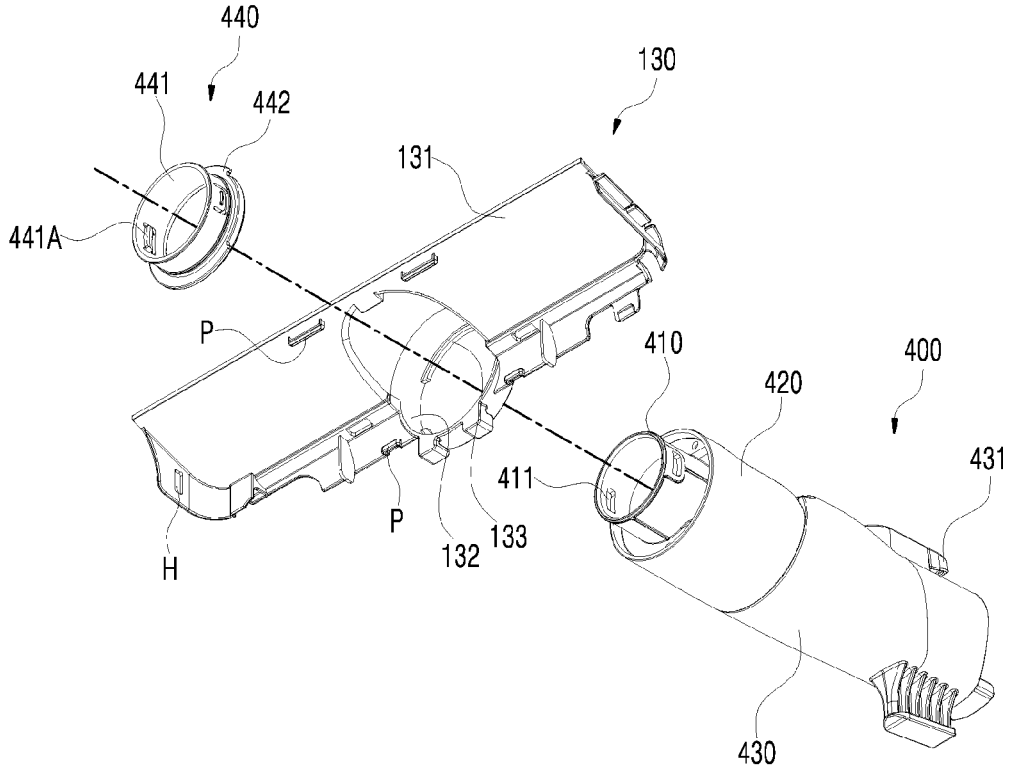
FIG. 7 is an exploded perspective view of the mounting housing and the connector of the suction nozzle of FIG. 4 seen from below.

FIG. 6 is an exploded perspective view of the mounting housing 130 and the connector 400 of the suction nozzle 10 of FIG. 4 seen from above. FIG. 7 is an exploded perspective view of the mounting housing 130 and the connector 400 of the suction nozzle 10 of FIG. 4 seen from below.

As illustrated in FIGS. 6 and 7, the mounting housing 130 may include a cover portion 131, a mounting portion 132, and an interposition portion 133.

The cover portion 131 may be a portion that is mounted in an upper portion of the main housing 110. In any one of the cover portion 131 or the main housing 110, a protrusion (P) may be formed. In the other one of the cover portion 131 or the main housing 110, a hole (H) may be formed. As the protrusion (P) is inserted into the hole (H), the cover portion 131 may be mounted in the upper portion of the main housing 110.

The mounting portion 132 may be a portion that surrounds the inlet 111 and a coupling part 440. The mounting portion 132 may be formed in a ring shape.

The interposition portion 133 may protrude from an inner surface of the mounting portion 132. The interposition portion 133 may be a portion that is rotatably mounted in the connector 400. The interposition portion 133 may protrude from the inner surface of the mounting portion 132 along a circumferential direction of the mounting portion 132.

As illustrated in FIGS. 4 and 5, the support housing 140 may support lower portions of the suction nozzle 10 and the connector 400.

In the support housing 140, a second wheel (W2) may be mounted. The second wheel (W2) may, together with the pair of first wheels (W1), rotate and roll on the floor.

The pair of first wheels (W1) and the second wheel (W2) may provide a rolling motion to the suction nozzle 10 and the connector 400. A pressing button 141 may be mounted in the support housing 140.

The connector 400 may enable relative rotation of the main body 20 and the suction nozzle 10. In addition, the connector 400 may form therein the passage 401 through which dust moves to the main body 20.

As illustrated in FIGS. 6 and 7, the connector 400 may include an insertion portion 410, a first connection portion 420, a second connection portion 430, a coupling part 440, and an elastic pipe 450.

Each of the first connection portion 420 and the second connection portion 430 may be formed in a pipe shape. The first connection portion 420 and the second connection portion 430 may be rotatably coupled to each other.

Although not illustrated, in any one of the first connection portion 420 or the second connection portion 430, a pair of protrusions may be formed. In addition, in the other one of the first connection portion 420 or the second connection portion 430, a pair of grooves may be formed.

The pair of protrusions may be formed on an outer surface of the second connection portion 430 at both sides thereof. The pair of grooves may be formed on an inner surface of the first connection portion 420 at both sides thereof. The protrusions may be inserted into the grooves. The second connection portion 430 may be rotated about the protrusions inserted into the grooves. Reference sign "X" in FIG. 6 indicates an extension line of the rotational axis formed by the protrusions.

As illustrated in FIG. 5, in an upper portion of the second connection portion 430, a release button 431 may be formed. The release button 431 may be connected to an engaging portion 432. In an upper portion of the second connection portion 430, a hole may be formed. The engaging portion 432 may protrude into the second connection portion 430 through the hole.

In the extension pipe 30, a hole into which the engaging portion 432 is inserted may be formed. Movement of the extension pipe 30 may be blocked by the engaging portion 432.

When a user presses the release button 431, the engaging portion 432 may move upward and be released from the hole of the extension pipe 30. Accordingly, the second connection portion 430 and the extension pipe 30 may be separated from each other.

When an external force applied to the release button 431 is removed, the release button 431 may rise again by means of the elasticity of itself. When the external force applied to the release button 431 is removed, the engaging portion 432 may move downward again.

As illustrated in FIG. 5, the elastic pipe 450 may form the passage 401 between the inlet 111 and the second connection portion 430. The elastic pipe 450 may include an elastic tube 451 and a coil spring 452.

The elastic tube 451 may form therein the passage 401. The elastic tube 451 may be formed in a cylindrical shape. The elastic tube 451 may be made of a soft resin. Accordingly, the elastic tube 451 may be elastically deformed when the first connection portion 420 and the second connection portion 430 are relatively rotated, and when the mounting portion 132 and the first connection portion 420 are relatively rotated.

The coil spring 452 may be attached to an inner surface or an outer surface of the elastic tube 451. The coil spring 452 may maintain the cylindrical shape of the elastic tube 451.

In a compressed state, the coil spring 452 may be mounted between the inlet 111 and the second connection portion 430. In each of the inlet 111 and the second connection portion 430, a raised portion may be formed, and both end portions of the coil spring 452 may be caught by the raised portions of the inlet 111 and the second connection portion 430.

A distance between the raised portions of the inlet 111 and the second connection portion 430 may change when the first connection portion 420 and the second connection portion 430 are relatively rotated, and when the mounting portion 132 and the first connection portion 420 are relatively rotated.

The elastic tube 451 may be maintained to be in close contact with the raised portions of the inlet 111 and the second connection portion 430 by means of the elasticity of the coil spring 452 while the first connection portion 420 and the second connection portion 430 are relatively rotated, and the mounting portion 132 and the first connection portion 420 are relatively rotated.

Figure 8:
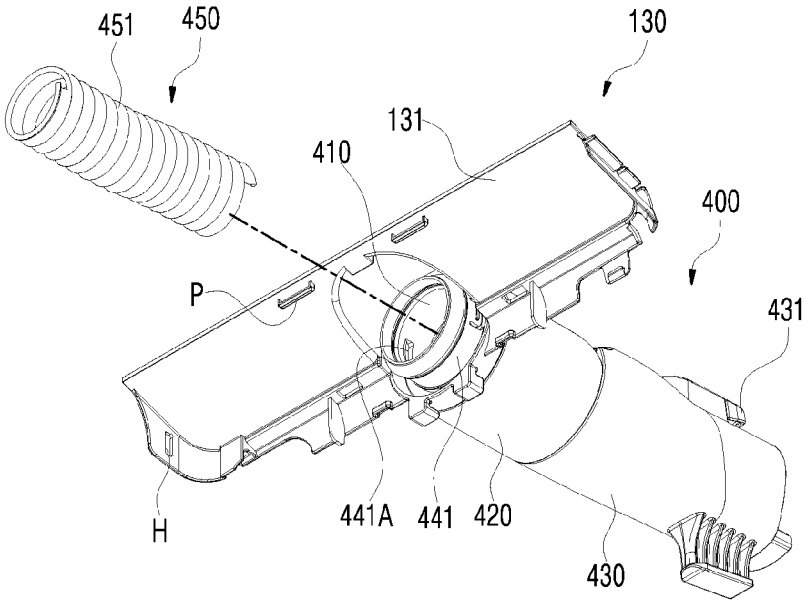
FIG. 8 is a perspective view of an assembled state of the mounting housing and the connector of the suction nozzle of FIG. 4.
Figure 9:
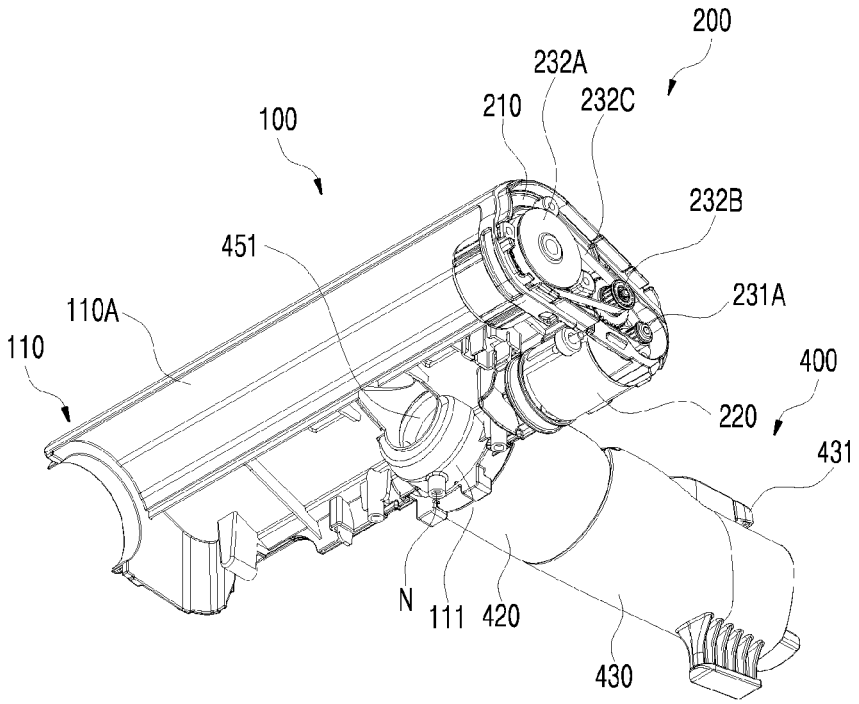
FIG. 9 is a perspective view of an assembled state of the main housing, the mounting housing, and the connector of the suction nozzle of FIG. 4.

FIG. 8 is a perspective view of an assembled state of the mounting housing 130 and the connector 400 of the suction nozzle 10 of FIG. 4. FIG. 9 is a perspective view of an assembled state of the main housing 110, the mounting housing 130, and the connector 400 of the suction nozzle 10 of FIG. 4.

Figure 10:
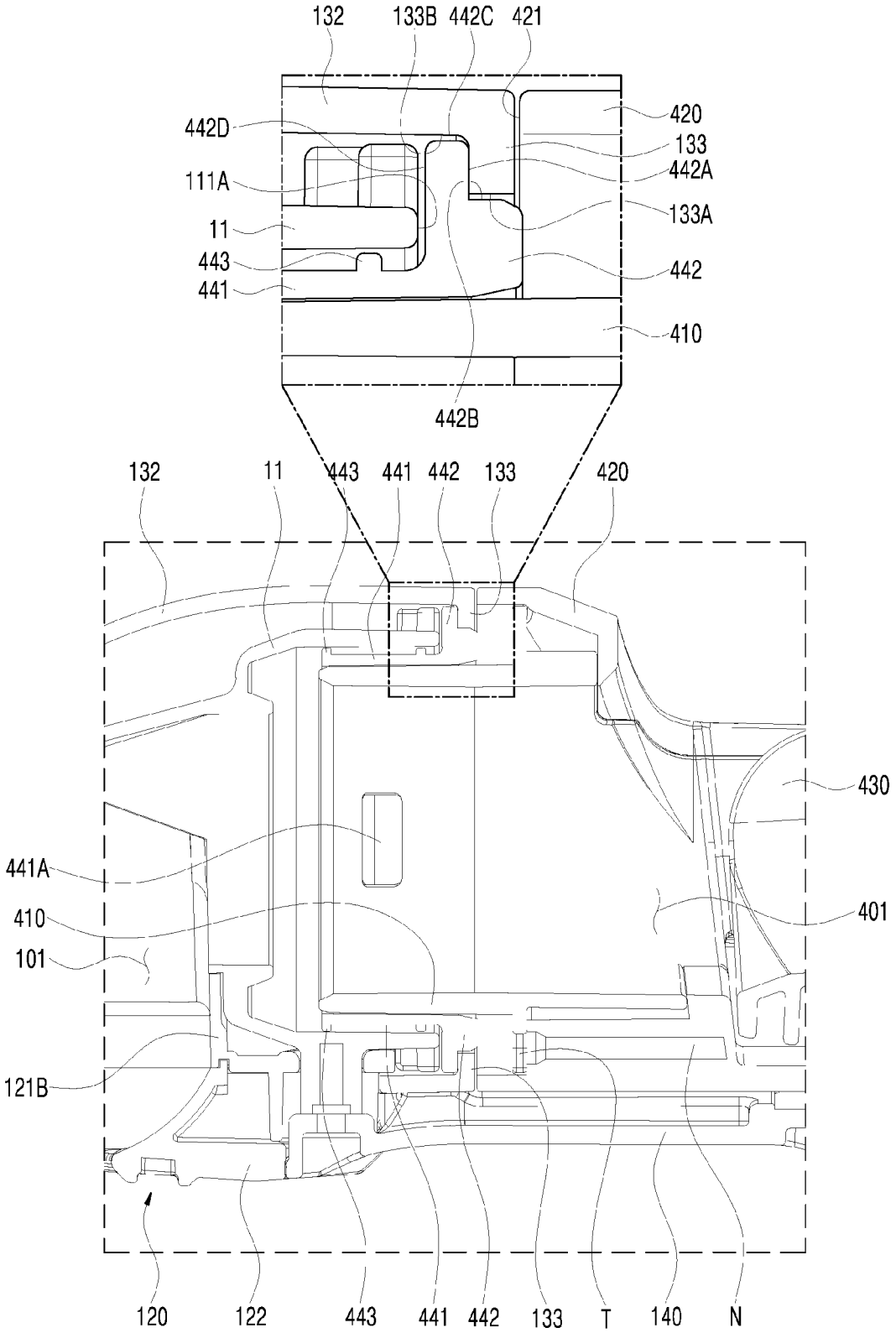
FIG. 10 is a partial cross-sectional view of an assembled state of the main housing, the mounting housing, and the connector of the suction nozzle of FIG. 9.

FIG. 10 is a partial cross-sectional view of an assembled state of the main housing 110, the mounting housing 130, and the connector 400 of the suction nozzle 10 of FIG. 9.

The insertion portion 410 may be formed in a pipe shape having a diameter smaller than a diameter of the first connection portion 420. The insertion portion 410 may be coupled inside the first connection portion 420 by means of a bolt. In the first connection portion 420, a fastening portion (N) to which a bolt is screw-coupled may be formed. In the insertion portion 410, an insertion portion (T) into which a bolt is inserted may be formed.

The insertion portion 410 may protrude forward from inside the first connection portion 420. A front surface of the first connection portion 420 may be formed in a ring shape surrounding the insertion portion 410.

The coupling part 440 may connect the mounting housing 130 and the connector 400 to each other in such a manner that the mounting housing 130 and the connector 400 rotate about the insertion portion 410. The coupling part 440 may restrain forward and backward movements of the mounting portion 132 and the interposition portion 133 with respect to the first connection portion 420. In other words, the coupling part 440 may restrain forward and backward movements of the insertion portion 410 and the first connection portion 420 with respect to the interposition portion 133.

After the insertion portion 410 is inserted into the mounting portion 132, the coupling part 440 may be mounted in an outer surface of the insertion portion 410. Thereafter, the elastic pipe 450 may be inserted into the insertion portion 410. Then, the cover portion 131 may be mounted in an upper portion of the main housing 110.

When the cover portion 131 is mounted in the upper portion of the main housing 110, the insertion portion 410 may be inserted into the inlet 111. The first connection portion 420 may be spaced apart from the inlet 111 in the direction of the passage 401. The "direction of the passage 401" should be understood as the "direction of the central axis of the insertion portion 410."

As illustrated in FIGS. 7 and 10, the coupling part 440 may include a pipe portion 441, a protrusion portion 442, and a spacing protrusion portion 443.

The pipe portion 441 may be formed in a cylindrical shape. When the coupling part 440 is mounted in the outer surface of the insertion portion 410, an inner surface of the pipe portion 441 may surround the outer surface of the insertion portion 410. Thereafter, when the cover portion 131 is mounted in the upper portion of the main housing 110, the inner surface of the inlet 111 may surround the outer surface of the pipe portion 441.

The spacing protrusion portion 443 may protrude from the outer surface of the pipe portion 441 in a circumferential direction. The pipe portion 441 may be spaced apart from the inner surface of the inlet 111 by means of the spacing protrusion portion 443. The spacing protrusion portion 443 may also be spaced apart from the inner surface of the inlet 111.

When an external force is applied to the connector 400, the spacing protrusion portion 443 may come into contact with the inner surface of the inlet 111. A contact surface between the spacing protrusion portion 443 and the inlet 111 may be relatively small compared to the outer surface of the pipe portion 441. Accordingly, even when the spacing protrusion portion 443 comes into contact with the inner surface of the inlet 111, relative rotation of the mounting housing 130 and the first connection portion 420 may be possible.

In the vacuum cleaner of related art 1, when the second connection member receives an external force from the first connection member, the second connection member may be deformed in the opposite direction to the first connection member, that is, in the outer direction. For this reason, related art 1 has a limitation in that the connection members, which are rotatably coupled, can easily become decoupled by an external force applied to the first connection member.

In the vacuum cleaner 1 of the present disclosure, when the coupling part 440 is mounted in the outer surface of the insertion portion 410, the inner surface of the pipe portion 441 may surround the outer surface of the insertion portion 410. Thereafter, when the cover portion 131 is mounted in the upper portion of the main housing 110, the inner surface of the inlet 111 may surround the outer surface of the pipe portion 441.

Accordingly, when the pipe portion 441, which has received the external force from the insertion portion 410, is deformed in the opposite direction to the insertion portion 410, that is, in the outer direction, the inner surface of the inlet 111 may serve as a boundary surface for preventing deformation of the pipe portion 441.

That is, even when the insertion portion 410 is deformed by the external force applied to the connector 400, and thus the external force is transferred to the pipe portion 441, the inlet 111 may have a rigidity by which deformation of the pipe portion 441 may be prevented.

Accordingly, the inlet 111 may prevent relative deformation of the insertion portion 410 and the coupling part 440. As a result, in the vacuum cleaner 1 of the present disclosure, even when a strong external force acts on the connector 400, the mounting portion 132 and the first connection portion 420 may not become decoupled from each other.

As illustrated in FIGS. 7 and 10, in any one of the insertion portion 410 or the pipe portion 441, a catch hole 411 may be formed. In the other one of the insertion portion 410 or the pipe portion 441, a catch portion 441A may be formed. For example, the catch portion 441A may be formed in the pipe portion 441, and the catch hole 411 may be formed in the insertion portion 410.

The catch portion 441A may protrude inward from an inner surface of the pipe portion 441. The protruding height of the catch portion 441A inside the pipe portion 441 may become smaller towards the backward direction.

When the insertion portion 410 is inserted into the coupling part 440, the catch portion 441A may be bent outwards by the outer surface of the insertion portion 410. When the catch portion 441A is inserted into the catch hole 411, the coupling part 440 may be mounted in the outer surface of the insertion portion 410.

The catch portion 441A may form a surface perpendicular to the direction of the passage 401. Accordingly, even when the coupling part 440 is pulled in the forward direction, a state in which the catch portion 441A is caught in the catch hole 411 may be maintained.

In the vacuum cleaner of related art 1, the connection members, which are rotatably connected to each other, may be coupled to each other by forceful insertion. Accordingly, when the connection members of related art 1 are decoupled from each other for the purpose of repairing and the like, the connection members can easily become worn or broken at areas that are coupled by the forceful insertion.

In the vacuum cleaner 1 of the present disclosure, by contrast, when the catch portion 441A is pushed outwards from inside the insertion portion 410, the catch portion 441A that is caught in the catch hole 411 may be easily released from the catch hole 411.

When the coupling part 440 is pulled forwards while the catch portion 441A is being pushed outwards from inside the insertion portion 410, the insertion portion 410 and the coupling part 440 may be easily decoupled from each other. Accordingly, the present disclosure has an advantage in that the mounting housing 130 and the first connection portion 420 can be easily decoupled without any abrasion or damage.

As illustrated in FIGS. 7 and 10, the protrusion portion 442 may protrude from the outer surface of the pipe portion 441 in the circumferential direction. The protrusion portion 442 may form a first boundary surface 442A.

The first connection portion 420 may form a second boundary surface 421. The second boundary surface 421 may be spaced apart from the first boundary surface 442A in the direction of the passage 401.

When the coupling part 440 is mounted in the outer surface of the insertion portion 410, the interposition portion 133 may be interposed between the first boundary surface 442A and the second boundary surface 421. The first boundary surface 442A and the second boundary surface 421 may block movement of the interposition portion 133 in the direction of the passage 401.

The first boundary surface 442A and the second boundary surface 421 may form a ring shape around a central axis of the insertion portion 410. The first boundary surface 442A and the second boundary surface 421 may face each other in a direction of the central axis of the insertion portion 410. Accordingly, the mounting housing 130 may be mounted in the connector 400 so as to rotate about the central axis of the insertion portion 410.

The protrusion portion 442 may form a third boundary surface 442B. The third boundary surface 442B may be formed on an outer surface of the protrusion portion 442 in a circumferential direction. The third boundary surface 442B may have a constant radius along the circumferential direction of the central axis of the insertion portion 410. The first boundary surface 442A and the third boundary surface 442B may form an angle of about 90 degrees.

The interposition portion 133 may form a fourth boundary surface 133A. The mounting portion 132 may form a circular ring shape. The interposition portion 133 may form the fourth boundary surface 133A along a circumferential direction of a central axis of the mounting portion 132. The second boundary surface 421 and the fourth boundary surface 133A may form an angle of about 90 degrees.

The third boundary surface 442B and the fourth boundary surface 133A may face each other in a radial direction of the pipe portion 441. The third boundary surface 442B and the fourth boundary surface 133A may come into close contact with each other when the insertion portion 410 moves in a radial direction. Accordingly, the third boundary surface 442B and the fourth boundary surface 133A may block radial directional movement of the insertion portion 410 with respect to the mounting portion 132.

The protrusion portion 442 may form a fifth boundary surface 442C. The fifth boundary surface 442C may be formed on an outer surface of the protrusion portion 442 in the circumferential direction.

The third boundary surface 442B may have a constant radius along the circumferential direction of the central axis of the insertion portion 410. The third boundary surface 442B and the fifth boundary surface 442C may form a stepped portion. The first boundary surface 442A and the fifth boundary surface 442C may form an angle of about 90 degrees.

On an inner surface of the mounting portion 132, a sixth boundary surface 133B may be formed. The inner surface of the mounting portion 132 may form a circular ring shape. The mounting portion 132 may form the sixth boundary surface 133B along the circumferential direction of the central axis of the mounting portion 132.

The fourth boundary surface 133A and the sixth boundary surface 133B may form a stepped portion. The second boundary surface 421 and the sixth boundary surface 133B may form an angle of about 90 degrees.

The fifth boundary surface 442C and the sixth boundary surface 133B may face each other in the radial direction of the pipe portion 441. The fifth boundary surface 442C and the sixth boundary surface 133B may come into close contact with each other when the insertion portion 410 moves in a radial direction. Accordingly, the fifth boundary surface 442C and the sixth boundary surface 133B may block radial directional movement of the insertion portion 410 from the mounting portion 132.

A rear surface of the inlet 111 may form a seventh boundary surface 111A. The seventh boundary surface 111A may form a ring shape around a central axis of the inlet 111.

A front surface of the protrusion portion 442 may form an eighth boundary surface 442D. The eighth boundary surface 442D may form a ring shape around the central axis of the pipe portion 441. The eighth boundary surface 442D may be spaced apart from the seventh boundary surface 111A in the direction of the passage 401.

When the coupling part 440 is mounted in the outer surface of the insertion portion 410, the rear surface of the inlet 111 and the front surface of the protrusion portion 442 may face each other in the radial direction of the pipe portion 441. Accordingly, the seventh boundary surface 111A and the eighth boundary surface 442D may block movement of the main housing 110 and the first connection portion 420 in the direction of the passage 401.

The actions of the first to eighth boundary surfaces can be summarized as follows.

(1) The first boundary surface 442A and the second boundary surface 421 may enable relative rotation between the housing 100 and the connector 400 about the central axis of the insertion portion 410.

(2) The first boundary surface 442A and the second boundary surface 421 may block relative movement between the housing 100 and the connector 400 in the direction of the passage 401.

(3) The seventh boundary surface 111A and the eighth boundary surface 442D may block relative movement between the housing 100 and the connector 400 in the direction of the passage 401.

(4) The third boundary surface 442B and the fourth boundary surface 133A may block relative movement between the housing 100 and the connector 400 in the radial direction.

(5) The fifth boundary surface 442C and the sixth boundary surface 133B may block relative movement between the housing 100 and the connector 400 in the radial direction.

The vacuum cleaner of related art 1 has a limitation in that when the first connection member rotates, friction is focused on the contact surface between the first connection member and the second connection member. The focused friction may accelerate abrasion of components.

In the vacuum cleaner 1 of the present disclosure, the relative rotation between the housing 100 and the connector 400 may be made by action no. (1). The relative movement between the housing 100 and the connector 400 in the direction of the passage 401 may be dually blocked by actions no. (2) and (3). The relative movement between the housing 100 and the connector 400 in the radial direction may be dually blocked by actions no. (4) and (5).

That is, when the first connection portion 420 rotates about the central axis of the insertion portion 410, friction may be dispersed to between the first boundary surface 442A and the second boundary surface 421, between the third boundary surface 442B and the fourth boundary surface 133A, between the fifth boundary surface 442C and the sixth boundary surface 133B, and between the seventh boundary surface 111A and the eighth boundary surface 442D.

Accordingly, the vacuum cleaner 1 of the present disclosure has an advantage in that when the first connection portion 420 rotates about the central axis of the insertion portion 410, the friction may be prevented from being focused on a specific area, which prevents abrasion of components.

Figure 11:
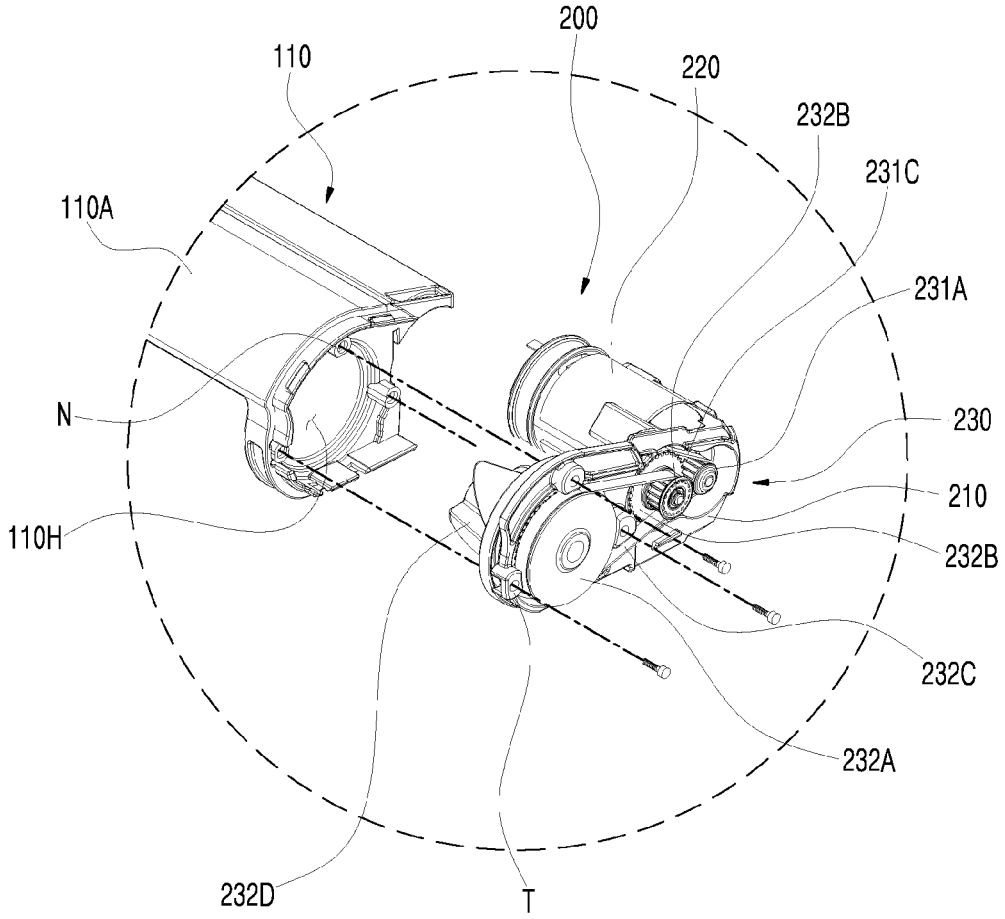
FIG. 11 is a partially exploded perspective view of the main housing of FIG. 5 and a driver.
Figure 12:
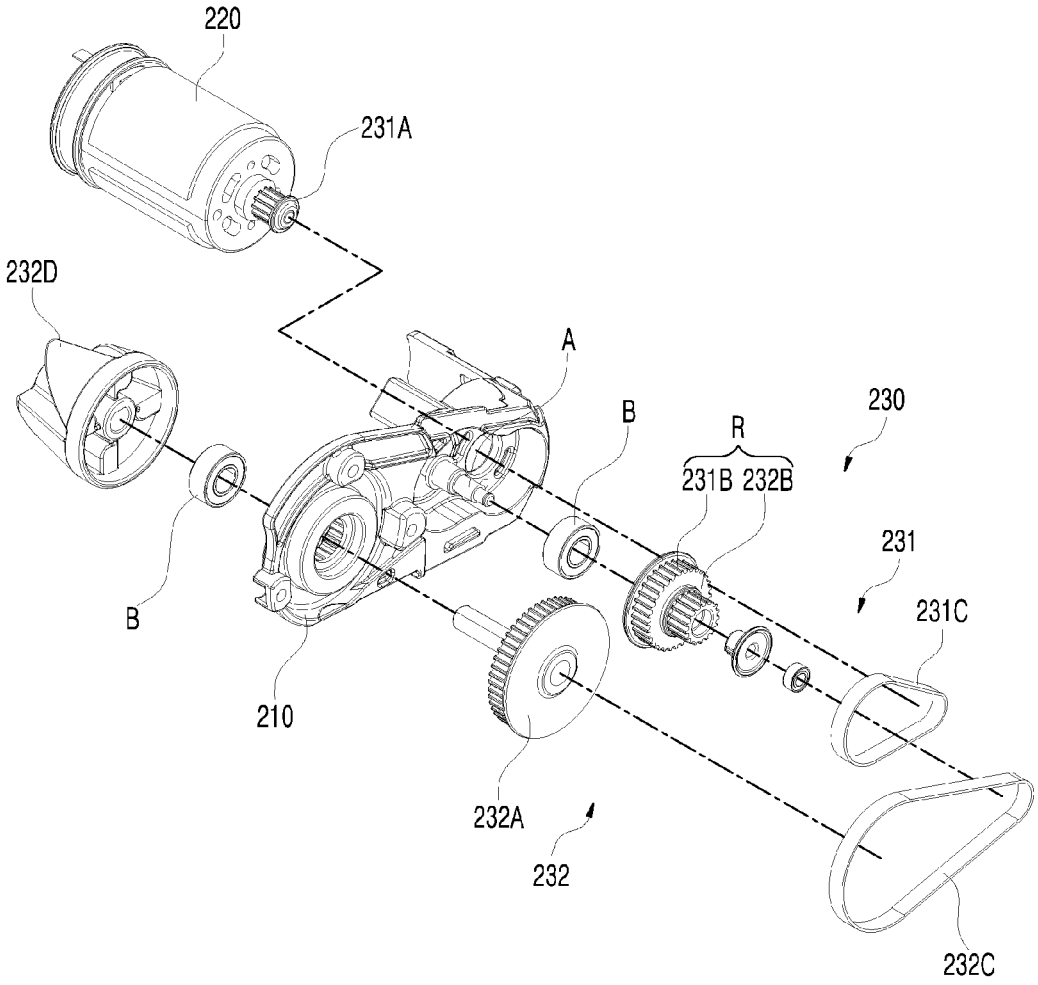
FIG. 12 is an exploded perspective view of the driver of FIG. 11.
Figure 13:
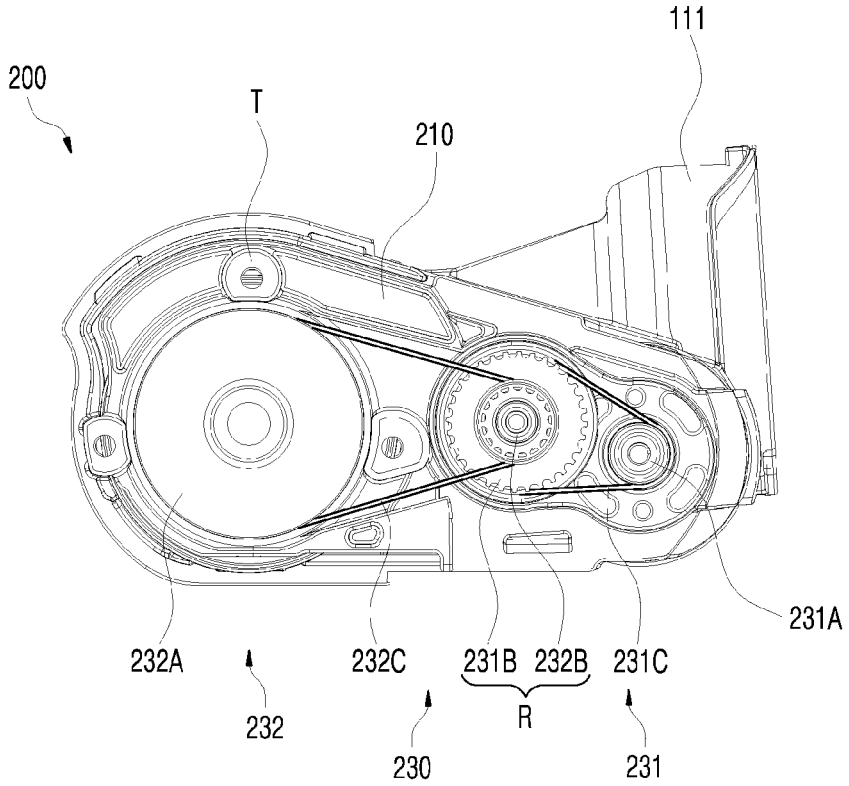
FIG. 13 is a side view of the driver of FIG. 11.

FIG. 11 is a partially exploded perspective view of the main housing 110 of FIG. 5 and a driver 200. FIG. 12 is an exploded perspective view of the driver 200 of FIG. 11. FIG. 13 is a side view of the driver 200 of FIG. 11.

The driver 200 may rotate the rotating brush 310. The driver 200 may be coupled to one side surface (hereinafter referred to as a "left side surface") of the main housing 110. As illustrated in FIG. 4, the side surface cover 150 may cover the driver 200. The side surface cover 150 may be coupled to a left side surface of the housing 100 by means of a locking structure such as a hook. In the side surface cover 150, a hole may be formed for inflow and outflow of air.

As illustrated in FIG. 11, the driver 200 may include a bracket 210, a motor 220, and a transmission 230.

The bracket 210 may be coupled to the main housing 110 by means of a bolt. The bracket 210 may block the left side surface of the main housing 110. In the left side surface of the main housing 110, a plurality of fastening portions (N) to which a bolt is screw-coupled may be formed. In the bracket 210, a plurality of insertion portions (T) to which a bolt is inserted may be formed.

The motor 220 may generate a rotational force. The motor 220 may be provided as a brushless direct current (BLDC) motor. The motor 220 may be coupled to the bracket 210. When the bracket 210 is coupled to the main housing 110, the motor 220 may be positioned behind the rotating brush 310. A rotational axis of the motor 220 may be aligned with a rotational axis of the rotating brush 310.

As illustrated in FIGS. 12 and 13, the transmission 230 may transfer rotational motion of the motor 220 to the rotating brush 310. The transmission 230 may be mounted in the bracket 210. The transmission 230 may include a first belt transmission 231 and a second belt transmission 232.

The first belt transmission 231 may transfer the rotational motion of the motor 220 to a middle pulley (R). When the bracket 210 is coupled to the main housing 110, the middle pulley (R) may be disposed between the motor 220 and the rotating brush 310. An axis of the middle pulley (R) may be aligned with the rotational axis of the rotating brush 310.

A fixing shaft (A) may be coupled to the bracket 210. The middle pulley (R) may be rotatably mounted in the fixing shaft (A) by means of a bearing (B). A groove may be formed in the fixing shaft (A). A snap ring (S) may be mounted in the groove so as to prevent deviation of the middle pulley (R).

The middle pulley (R) may include a first middle pulley 231B and a second middle pulley 232B. The first middle pulley 231B and the second middle pulley 232B may rotate simultaneously. The first middle pulley 231B and the second middle pulley 232B may be integrally produced.

On outer surfaces of the first middle pulley 231B and the second middle pulley 232B, equally-spaced grooves may be formed as in a gear. That is, on outer surfaces of the first middle pulley 231B and the second middle pulley 232B, teeth may be formed as in a gear. The number of teeth of the first middle pulley 231B may be greater than the number of the teeth of the second middle pulley 232B.

As illustrated in FIGS. 12 and 13, the first belt transmission 231 may include a driving pulley 231A, the first middle pulley 231B, and a first belt 231C.

The first belt transmission 231 may be spaced apart from the rotating brush 310. That is, the driving pulley 231A, the first middle pulley 231B, and the first belt 231C may be positioned in the opposite side to the rotating brush 310 with respect to the bracket 210.

The driving pulley 231A may be coupled to an axis of the motor 220. On an outer surface of the driving pulley 231A, teeth may be formed as in a gear. The number of teeth of the first middle pulley 231B may be greater than the number of the teeth of the driving pulley 231A.

The first belt 231C may be wound around the driving pulley 231A and the first middle pulley 231B. The first belt 231C may be wound around the driving pulley 231A and the first middle pulley 231B in the manner of an open belt. Accordingly, the first belt 231C may transfer rotational motion of the driving pulley 231A to the first middle pulley 231B in the same rotational direction.

The first belt 231C may be provided as a timing belt. Accordingly, the first belt 231C may accurately transfer the rotational motion of the driving pulley 231A to the first middle pulley 231B.

As described above, the number of the teeth of the first middle pulley 231B may be greater than the number of the teeth of the driving pulley 231A. Accordingly, a torque of the first middle pulley 231B may be greater than a torque of the driving pulley 231A. Also, a rotation speed of the first middle pulley 231B may be slower than a rotation speed of the driving pulley 231A.

The second belt transmission 232 may transfer rotational motion of the middle pulley (R) to the rotating brush 310. The second belt transmission 232 may include a driven pulley 232A, the second middle pulley 232B, a second belt 232C, and a first shaft member 232D.

The second belt transmission 232 may be spaced apart from the rotating brush 310. That is, the driven pulley 232A, the second middle pulley 232B, and the second belt 232C may be positioned in the opposite side to the rotating brush 310 with respect to the bracket 210.

The first shaft member 232D may be inserted into the rotating brush 310. The first shaft member 232D may have a diameter in a range not exceeding a diameter of the rotating brush 310, regardless of the capacity of the motor 220.

The driven pulley 232A may be rotatably mounted in the bracket 210. A hole may be formed in the bracket 210. The bearing (B) may be mounted in the hole. A shaft of the driven pulley 232A may be rotatably coupled to the bearing (B). The shaft of the driven pulley 232A may pass through the bracket 210. The shaft of the driven pulley 232A may be aligned with the rotational axis of the rotating brush 310.

The first shaft member 232D may transfer rotational motion of the driven pulley 232A to the rotating brush 310. A second shaft member 313 may be provided at one end of the rotating brush 310.

Hereinafter, for easy understanding of the present disclosure, the direction of a rotational axis of the rotating brush 310 will be referred to as "axial direction."

The first shaft member 232D may be inserted into the second shaft member 313 to transfer rotational motion to the second shaft member 313. A rotational axis of the first shaft member 232D may be on the same line as that of the rotational axis of the rotating brush 310.

The first shaft member 232D may be coupled to the shaft of the driven pulley 232A from the opposite side to the driven pulley 232A. When the bracket 210 is coupled to the main housing 110, the first shaft member 232D may be disposed inside the main housing 110. As illustrated in FIG. 11, in the left side surface of the main housing 110, a hole 110H into which the first shaft member 232D is inserted may be formed.

On an outer surface of the driven pulley 232A, teeth may be formed as in a gear. The number of teeth of the driven pulley 232A may be greater than the number of the teeth of the second middle pulley 232B.

The second belt 232C may be wound around the driven pulley 232A and the second middle pulley 232B. The second belt 232C may be wound around the driven pulley 232A and the second middle pulley 232B in the manner of an open belt.

The second belt 232C may transfer rotational motion of the second middle pulley 232B to the driven pulley 232A in the same rotational direction. Accordingly, a rotational direction of the motor 220 is the same as a rotational direction of the first shaft member 232D.

The second belt 232C may be provided as a timing belt. Accordingly, the second belt 232C may accurately transfer rotational motion of the second middle pulley 232B to the driven pulley 232A.

As described above, the number of the teeth of the driven pulley 232A may be greater than the number of the teeth of the second middle pulley 232B. Accordingly, a torque of the driven pulley 232A may be greater than a torque of the second middle pulley 232B. In addition, a rotation speed of the driven pulley 232A may be smaller than a rotation speed of the second middle pulley 232B.

As a result, a rotation speed of the first shaft member 232D may be smaller than a rotation speed of the motor 220, and a torque of the first shaft member 232D may be greater than a torque of the motor 220. The rotating brush 310 may rotate with relatively high torque, moving dust and debris on the floor to the suction space 101.

Figure 14:
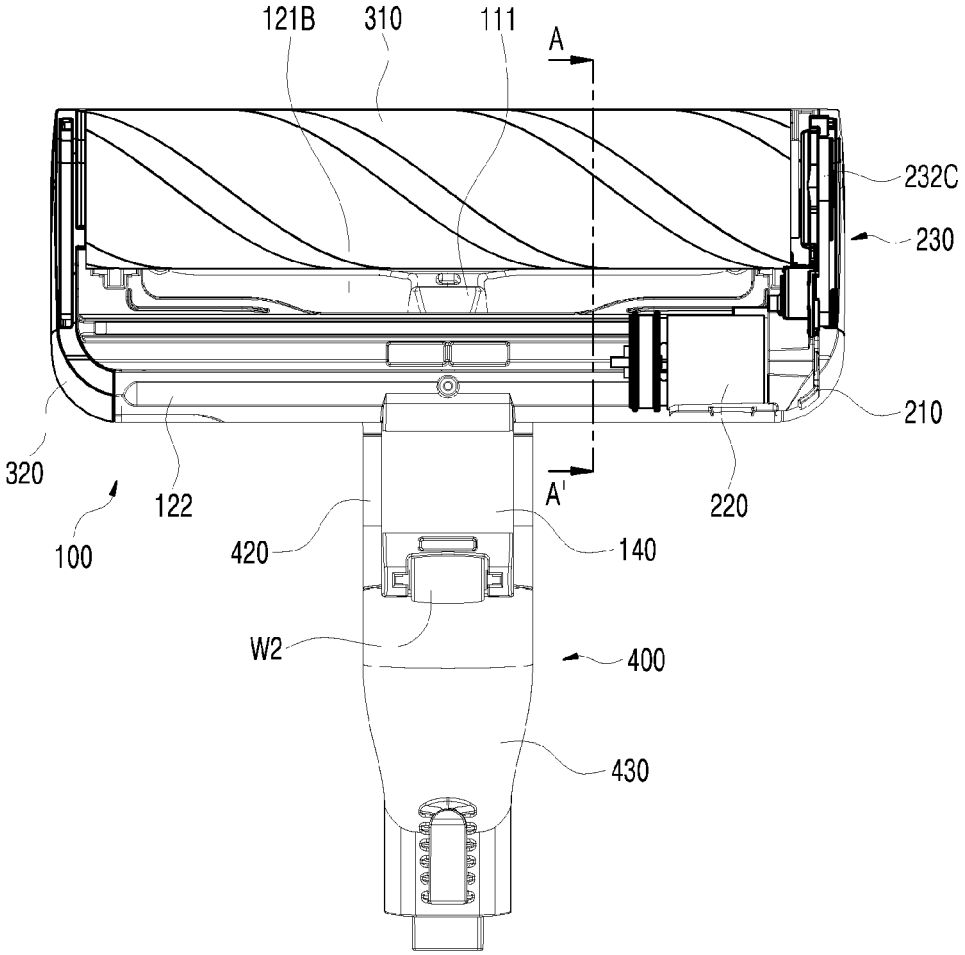
FIG. 14 is a bottom view of the suction nozzle of FIG. 2.
Figure 15:
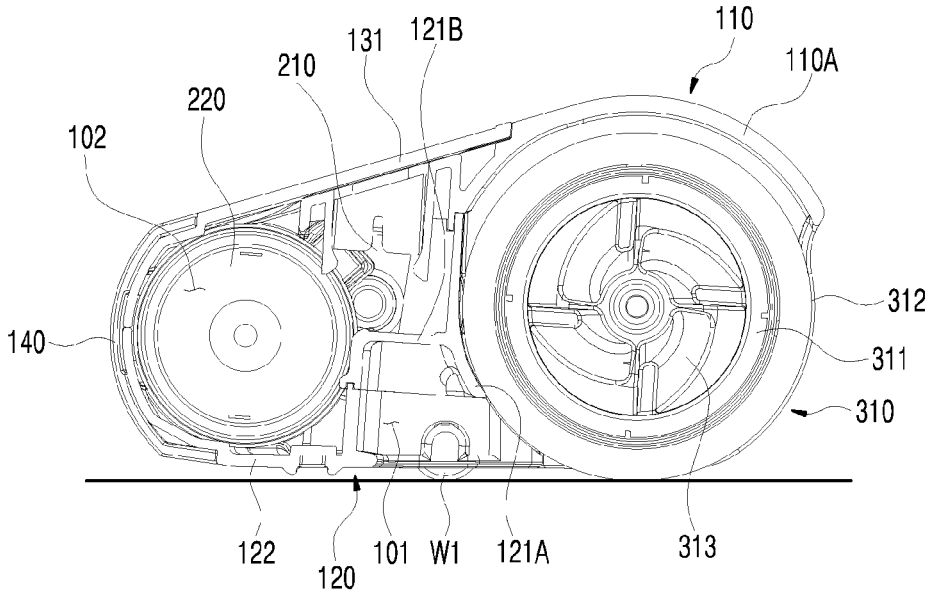
FIG. 15 is a cross-sectional view of the suction nozzle of FIG. 14 when the suction nozzle is cut along the line from A to A'.

FIG. 14 is a bottom view of the suction nozzle 10 of FIG. 2. FIG. 15 is cross-sectional view of the suction nozzle 10 of FIG. 14 when the suction nozzle 10 is cut along the line from A to A'.

As illustrated in FIGS. 13 and 14, when the bracket 210 is coupled to the main housing 110, the motor 220 may be positioned behind the rotating brush 310. The rotational motion of the motor 220 may be transferred to the rotating brush 310, which is spaced apart from the motor 220, by the first belt transmission 231 and the second belt transmission 232.

The position of the middle pulley (R) may be determined depending on a distance between the motor 220 and the rotating brush 310. In addition, a length of the first belt 231C may be determined depending on a distance between the driving pulley 231A and the first middle pulley 231B and on diameters of the driving pulley 231A and the first middle pulley 231B. In addition, a length of the second belt 232C may be determined depending on a distance between the driven pulley 232A and the second middle pulley 232B and on diameters of the driven pulley 232A and the second middle pulley 232.

Components of the vacuum cleaner 1 may have various specifications depending on the use of the vacuum cleaner 1. The capacity of the motor 220 and the diameter and the material of the rotating brush 310 may also be variously determined depending on the use of the vacuum cleaner 1.

For example, a vacuum cleaner for use in shops may include a motor with a greater capacity and a rotating brush with a greater diameter than those of a vacuum cleaner for use in a household. The material of the rotating brush may be determined from among metal and a synthetic resin depending on the use of the vacuum cleaner.

However, for the vacuum cleaner of related art 1, the diameter of the rotating brush must necessarily be considered when the motor is selected. Accordingly, related art 1 has a limitation in that the capacity of the motor cannot be increased to a desired level.

Meanwhile, as for the vacuum cleaner for use in a household, a relatively lower height of the suction nozzle may be more advantageous in terms of usability. This is because a relatively lower height of the suction nozzle enables easy access to spaces with a relatively low height.

However, in related art 1, when determining the diameter of the rotating brush, the size and shape of the motor must necessarily be considered. Accordingly, related art 1 has a limitation in that the diameter of the rotating brush cannot be decreased to a desired level.

In the vacuum cleaner 1 of the present disclosure, the driver 200 may be positioned outside the rotating brush 310. Accordingly, the present disclosure has an advantage in that the diameter of the rotating brush 310 may be determined regardless of the size and shape of the motor 220.

In addition, the present disclosure has an advantage in that the capacity of the motor 220 may be determined regardless of the diameter of the rotating brush 310.

When the suction nozzle 10 is moved back and forth, inertia may act on the suction nozzle 10 in the movement direction. In the vacuum cleaner of related art 1, the center of gravity of the suction nozzle is focused on the front side of the suction nozzle. Accordingly, when the suction nozzle is moved forwards, the back of the suction nozzle may be lifted by the inertia.

In addition, when the suction nozzle is inclined forwards, friction between the rotating cleaning unit and the floor increases. Excessive friction between the rotating cleaning unit and the floor may damage the floor.

In the vacuum cleaner 1 of the present disclosure, the driver 200 may be positioned behind the rotating brush 310. Accordingly, the center of gravity of the suction nozzle 10 of the present disclosure may be located further to the rear in comparison to the center of gravity of the suction nozzle of the vacuum cleaner of related art 1. Accordingly, in the vacuum cleaner 1 of the present disclosure, there is a lesser likelihood of the suction nozzle 10 becoming inclined forwards while the suction nozzle 10 is moved back and forth.

When the suction nozzle 10 is relatively heavy, the usability of the vacuum cleaner 1 may decrease. In the case of an upright type vacuum cleaner, wheels and a rotating brush in a housing are rubbed against the floor. Thus, a physically weak user, such as an elderly person or a child, may not be able to smoothly move the upright type vacuum cleaner.

Accordingly, there is a need to reduce the weight of the suction nozzle of the upright type vacuum cleaner. However, for conventional vacuum cleaners, a two-stage planetary gear set composed of many parts is generally used.

In the vacuum cleaner 1 of the present disclosure, the rotational motion of the motor 220 may be transferred to the rotating brush 310 by the first belt transmission 231 and the second belt transmission 232. A belt transmission transfers rotational motion through a simple pulley-belt structure. Accordingly, the transmission 230 may have advantages compared to the two-stage planetary gear set in that the number of parts and the weight of the transmission 230 significantly decrease.

As illustrated in FIG. 15, the mounting housing 130, along with the main housing 110, the lower housing 120, and the bracket 210, may form an isolated space 102. The isolated space 102 may be a space isolated from the suction space 101. The isolated space 102 may be positioned behind the rotating brush 310. The dust and debris in the suction space 101 may not be able to enter the isolated space 102.

When the bracket 210 is coupled to the main housing 110, the motor 220 may be provided in the isolated space 102. In addition, the first belt transmission 231 and the second belt transmission 232 may be isolated from the suction space 101 by the bracket 210. Accordingly, even when the driver 200 is not inserted into the rotating brush 310, contamination of the driver 200 caused by dust and debris may be prevented.

When the rotating brush 310 rubs the floor, the temperature of the rotating brush 310 may increase. In the vacuum cleaner of related art 1, the motor and the gear unit may be positioned within the rotating brush. Accordingly, the vacuum cleaner of related art 1 has a limitation in that heat emission of the motor and the gear unit is relatively slow. Such an increase in the temperature of the motor and the gear unit directly leads to a decrease in performance and failure of the motor and gear unit.

In the vacuum cleaner 1 of the present disclosure, the driver 200 may be spaced apart from the rotating brush 310. In particular, the motor 220, the pulleys, and the belts, which generate heat energy, may be positioned in the isolated space 102 isolated from the rotating brush 310. The vacuum cleaner 1 of the present disclosure has an advantage in that the heat energy of the motor 220, the pulleys, and the belts is quickly discharged through the bracket 210 and the housing 100.

Figure 16:
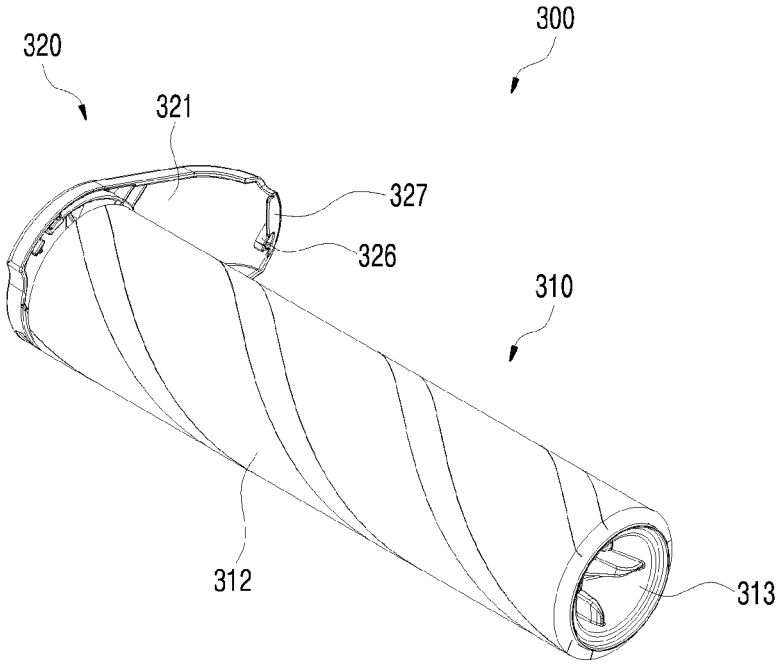
FIG. 16 is a perspective view of a brush module of FIG. 4.
Figure 17:
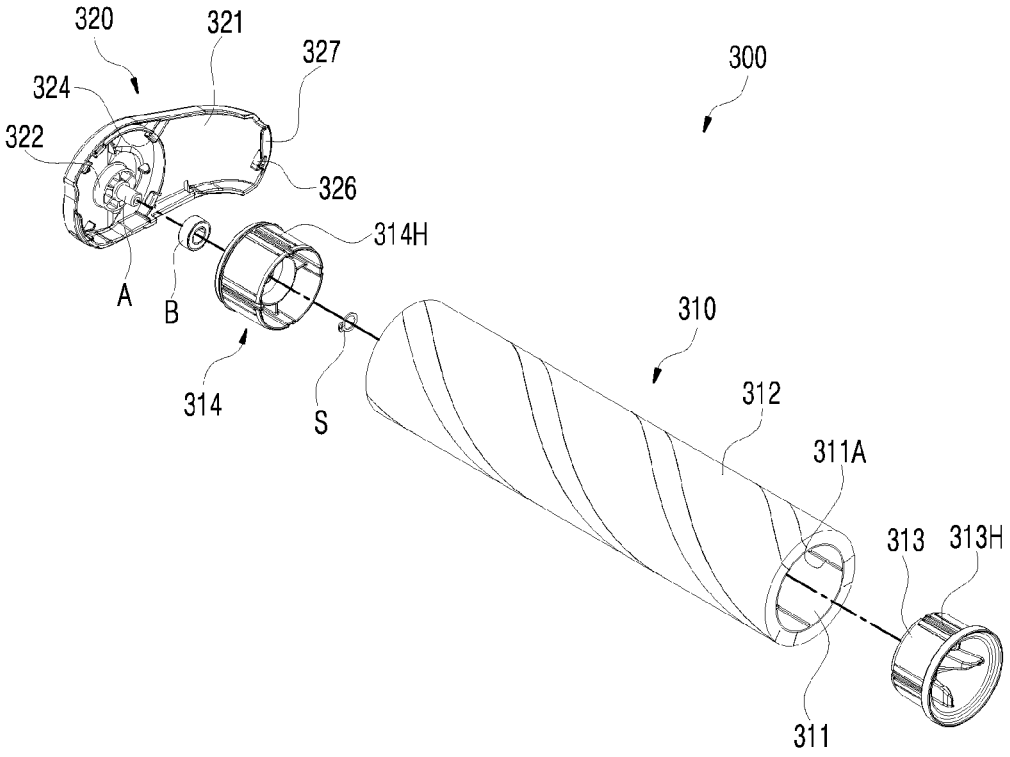
FIG. 17 is an exploded perspective view of the brush module of FIG. 16.
Figure 18:
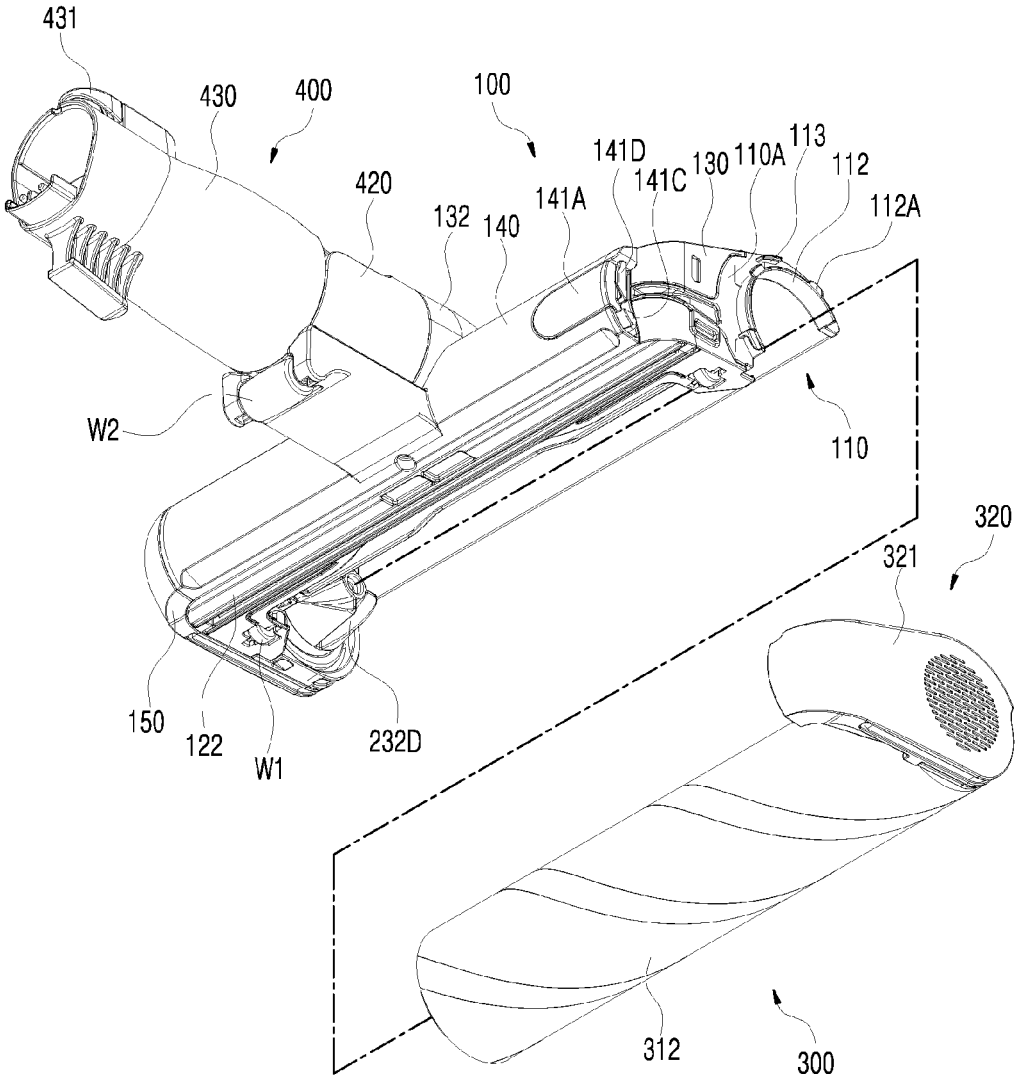
FIG. 18 is a perspective view of the suction module of FIG. 2 with the brush module separated.

FIG. 16 is a perspective view of the brush module 300 of FIG. 4. FIG. 17 is an exploded perspective view of the brush module 300 of FIG. 16. FIG. 18 is a perspective view of the suction module 10 of FIG. 2 with the brush module 300 separated.

As illustrated in FIGS. 16 and 17, the brush module 300 may include the rotating brush 310 and the detachable cover 320.

The rotating brush 310 may push dust and debris on the floor to behind the rotating brush 310. The rotating brush 310 may include a body 311, a brush member 312, a second shaft member 313, and a third shaft member 314.

The body 311 may form the frame of the rotating brush 310. The body 311 may be formed in the shape of a hollow cylinder. A central axis of the body 311 may act as a central axis of the rotating brush 310. The body 311 may have a rotational inertia which is uniform along the circumferential direction thereof. The body 311 may be produced of a synthetic resin or metal.

The brush member 312 may be attached onto an outer surface of the body 311. The brush member 312 may include a plurality of bristles. When the body 311 rotates, the plurality of bristles may lift dust and debris on the floor into the air. The plurality of bristles may include fiber bristles and metal bristles.

The fiber bristles and the metal bristles may be disposed randomly on the outer surface of the body 311. The fiber bristles and the metal bristles may be directly attached to the outer surface of the body 311. Although not illustrated, a fiber layer may be attached to the outer surface of the body 311. Then, the fiber bristles and the metal bristles may be attached to the fiber layer.

The fiber bristles may be produced of a synthetic resin, such as nylon. The metal bristles may include a conductive material. The metal bristles may be produced by coating bristles made of a synthetic resin with a conductive material.

Static electricity generated in the fiber bristle may be discharged to the floor or removed through the metal bristle. Accordingly, a phenomenon in which static electricity is transferred to the user may be prevented from occurring.

As illustrated in FIGS. 16 and 17, the second shaft member 313 may receive rotational motion of the first shaft member 232D. The second shaft member 313 may be provided in an opening at one side of the body 311. The second shaft member 313 may be inserted into the opening at one side of the body 311.

An insertion groove 313H may be formed on an outer surface of the second shaft member 313. A protruding portion 311A may be formed along the length direction of an inner surface of the body 311. When the second shaft member 313 is inserted into the opening of the body 311, the protruding portion 311A may be inserted into the insertion groove 313H. The protruding portion 311A may block relative rotation of the second shaft member 313.

In the second shaft member 313, a space into which the first shaft member 232D is inserted may be formed. When the rotating brush 310 moves in the axial direction thereof, the first shaft member 232D may be inserted into the second shaft member 313.

The first shaft member 232D and the second shaft member 313 may engage each other on a plurality of contact surfaces. When the first shaft member 232D and the second shaft member 313 engage each other, a rotational axis of the first shaft member 232D and a rotational axis of the second shaft member 313 may be on the same line.

Rotational motion of the first shaft member 232D may be transferred to the second shaft member 313 through the contact surfaces. With the first shaft member 232D and the second shaft member 313 engaging each other, the rotational axis of the rotating brush 310 and the rotational axis of the first shaft member 232D may be on the same line.

As illustrated in FIGS. 16 and 17, the third shaft member 314 may connect the body 311 to the detachable cover 320 in such a manner that the body 311 rotates. The third shaft member 314 may be provided in an opening at the other side of the body 311. The third shaft member 314 may be inserted into the opening at the other side of the body 311.

An insertion groove 314H may be formed on an outer surface of the second shaft member 314. A protruding portion 311A may be formed along the length direction of an inner surface of the body 311. When the third shaft member 314 is inserted into the opening of the body 311, the protruding portion 311A may be inserted into the insertion groove 314H. The protruding portion 311A may block relative rotation of the third shaft member 314.

A bearing (B) may be mounted in the third shaft member 314. A fixing shaft (A) may be provided in the detachable cover 320. The bearing (B) may support the fixing shaft (A) in such a manner that the fixing shaft (A) rotates. A groove may be formed in the fixing shaft (A). A snap ring (S) may be mounted in the groove to prevent separation of the third shaft member 314 and the fixing shaft (A).

The detachable cover 320 may be rotated about the rotational axis of the rotating brush 310 to be detachably coupled to the housing 100.

Figure 19:
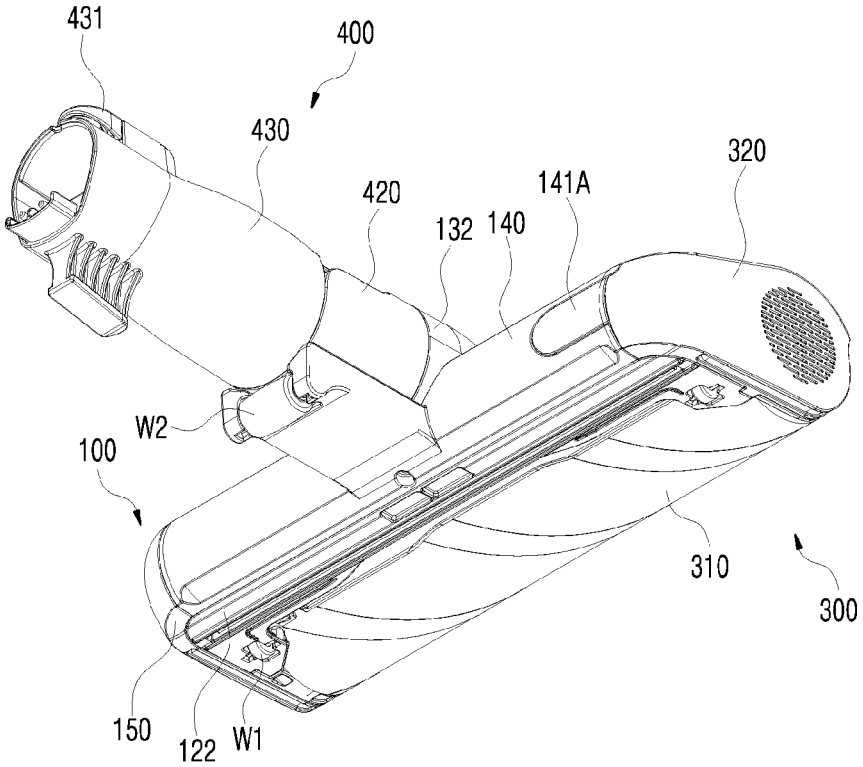
FIG. 19 is a perspective view of the suction module of FIG. 2 with the housing and the detachable cover coupled.
Figure 20:
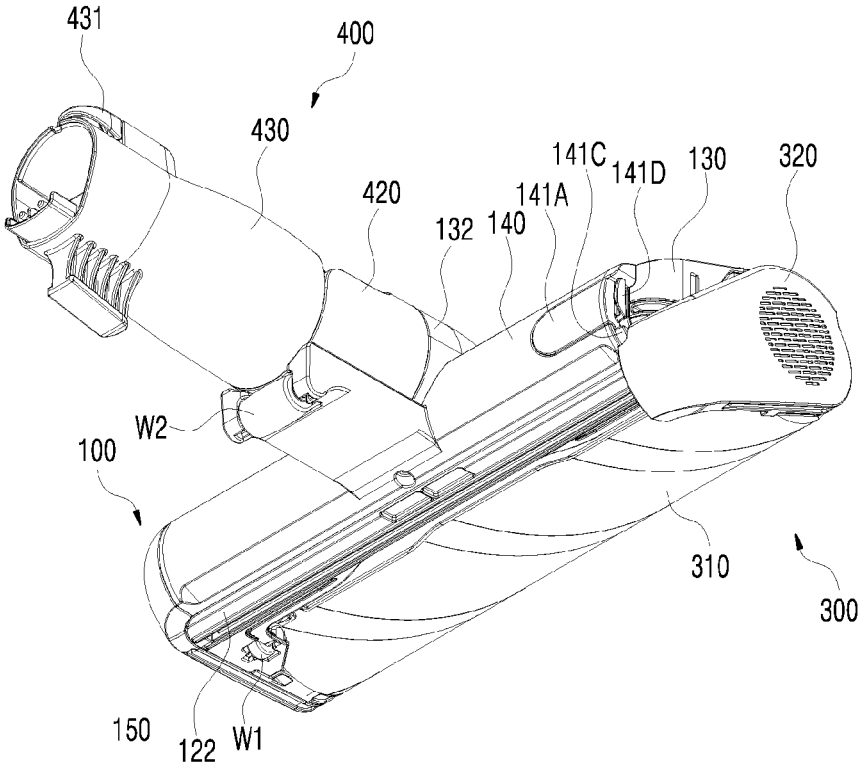
FIG. 20 is a perspective view of the suction module of FIG. 2 with the housing and the detachable cover decoupled.

FIG. 19 is a perspective view of the suction module 10 of FIG. 2 with the housing 100 and the detachable cover 320 coupled. FIG. 20 is a perspective view of the suction module 10 of FIG. 2 with the housing 100 and the detachable cover 320 decoupled.

Hereinafter, for easy understanding of the present disclosure, a state in which the detachable cover 320 is coupled to the housing 100 will be referred to as "coupled state." Also, a state in which the detachable cover 320 is decoupled from the housing 100 by rotating about the rotational axis of the rotating brush 310 will be referred to as "decoupled state."

In the decoupled state of FIG. 20, when the detachable cover 320 is pulled in the axial direction, the brush module 300 may be separated from the housing 100 as in FIG. 18.

Hereinafter, for easy understanding of the present disclosure, a rotational direction in which the detachable cover 320 is coupled to the housing 100 will be referred to as a "first rotational direction." A rotational direction in which the detachable cover 320 is decoupled from the housing 100 will be referred to as a "second rotational direction."

In the decoupled state of FIG. 20, when the detachable cover 320 is rotated in the first rotational direction, the detachable cover 320 may be coupled to the housing 100 as in FIG. 19.

Figure 21:
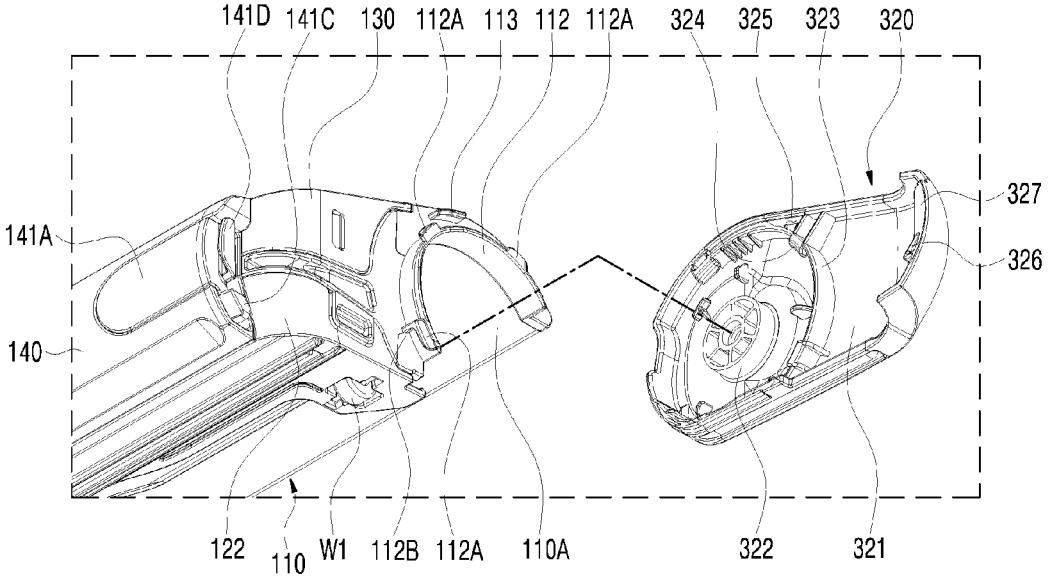
FIG. 21 is a perspective view of the suction module of FIG. 18 with the rotating brush unillustrated.
Figure 22:
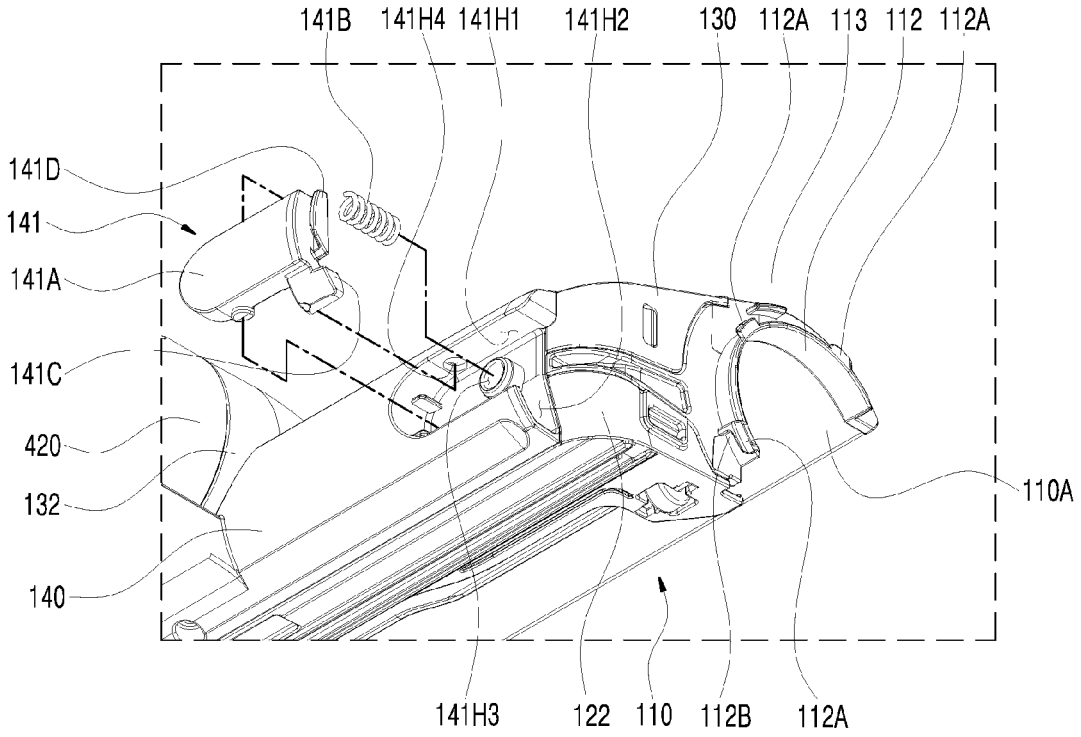
FIG. 22 is a perspective view of the suction module of FIG. 21 with a pressing button separated.
Figure 23:
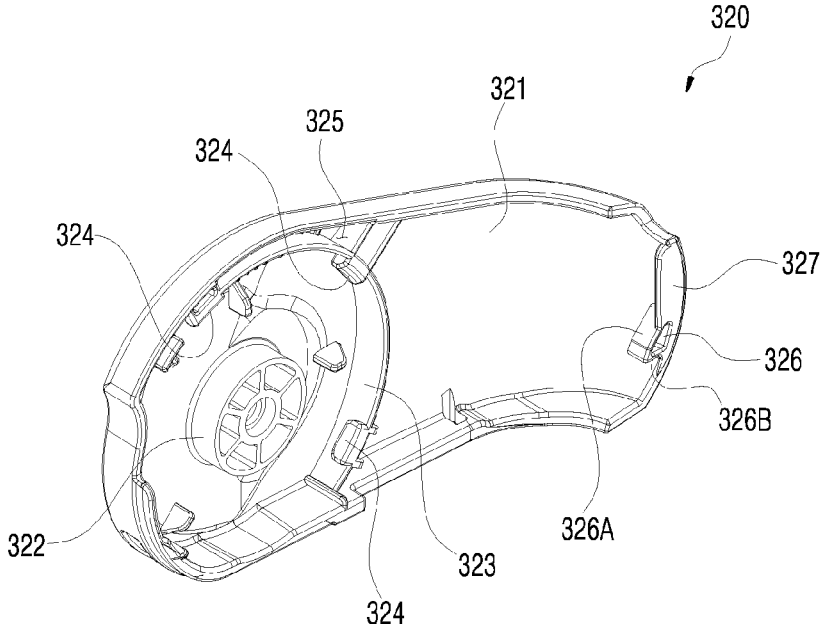
FIG. 23 is a perspective view of the detachable cover of FIG. 21.

FIG. 21 is a perspective view of the suction module 10 of FIG. 18 with the rotating brush 310 unillustrated. FIG. 22 is a perspective view of the suction module 10 of FIG. 21 with the pressing button 141 separated. FIG. 23 is a perspective view of the detachable cover 320 of FIG. 21.

As illustrated in FIGS. 21 and 22, at one side surface (hereinafter referred to as a "right side surface") of the main housing 110, a guide rail 112, a plurality of first walls 112A, a plurality of second walls 112B, and a second protrusion 113.

The guide rail 112 may be formed on the right side surface of the main housing 110. The guide rail 112 may be formed along the circumferential direction of the rotational axis of the first shaft member 232D.

An outer surface of the guide rail 112 may guide a rotation of first protrusions 324 about the rotational axis of the first shaft member 232D. The first protrusions 324 may be guided to the outer surface of the guide rail 112 and rotate in the first rotational direction and the second rotational direction.

The first walls 112A may be formed on the outer surface of the guide rail 112. The first walls 112A may protrude from the outer surface of the guide rail 112. The first protrusions 324 may rotate in the first rotational direction to enter between the first walls 112A and the main housing 110. Here, the first walls 112A may block axial-directional movement of the first protrusions 324.

The second walls 112B may be formed on the outer surface of the guide rail 112. The second walls 112B may protrude from the outer surface of the guide rail 112. In the coupled state, the second walls 112B may block rotation of the first protrusions 324 in the first rotational direction.

The second protrusion 113 may be formed on the right side surface of the main housing 110. The second protrusion 113 may be formed on the right side surface of the main housing 110. In the detachable cover 320, a guide groove 325 may be formed along an approximately circumferential direction of the fixing shaft (A).

An inner surface of the guide groove 325 may guide a rotation of the second protrusion 113 about the rotational axis of the rotating brush 310. In the coupled state and the decoupled state, the second protrusion 113 may be maintained in a state of being inserted into the guide groove 325.

As illustrated in FIGS. 21 and 22, the pressing button 141 may be mounted in the support housing 140. The pressing button 141 may selectively block rotation of the detachable cover 320. The pressing button 141 may include a button portion 141A, an elastic member 141B, a first blocking portion 141C, and a second blocking portion 141D.

The button portion 141A may form a surface that the user pushes on. A first mounting groove 141H1 into which the button portion 141A is inserted may be formed in the support housing 140.

A pair of shaft portions 141E may be formed in the button portion 141A. The pair of shaft portions 141E may be formed on both side surfaces of the button portion 141A. A pair of shaft grooves 141H4 may be formed on an inner surface of the first mounting groove 141H1. The pair of shaft grooves 141H4 may be formed on inner side surfaces of the first mounting groove 141H1 at both sides thereof.

The shaft portions 141E may be inserted into the shaft grooves 141H4. The button portion 141A may be rotated about the shaft portions 141E inserted into the shaft grooves 141H4.

The first blocking portion 141C may extend from the button portion 141A. In the coupled state, the first blocking portion 141C may block rotation of a third protrusion 326.

A second mounting groove 141H2 may be formed in the support housing 140. A part of the first blocking portion 141C may be inserted into the second mounting groove 141H2. The first blocking portion 141C may rotate within the second mounting groove 141H2 about the shaft portions 141E.

When the user pushes the button portion 141A, the pressing button 141 may be rotated about the shaft portions 141E. Here, the first blocking portion 141C may deviate from a rotational route of the third protrusion 326.

The elastic member 141B may be interposed between the button portion 141A and the housing 100. The elastic member 141B may form a force that pushes the button portion 141A outwards between the shaft portions 141E and the first blocking portion 141C.

Accordingly, when an external force applied to the button portion 141A is removed, the first blocking portion 141C may return to the rotational route of the third protrusion 326. In the support housing 140, a third mounting groove 141H3 into which the elastic member 141B is inserted may be formed.

The second blocking portion 141D may extend from the button portion 141A. In the coupled state, the second blocking portion 141D may block axial-directional movement of a fourth protrusion 327. In the coupled state, axial-directional movement of the fourth protrusion 327 may be blocked by the second blocking portion 141D.

The detachable cover 320 may rotatably support the rotating brush 310. The detachable cover 320 may be rotated about the rotational axis of the rotating brush 310 to be detachably coupled to the housing 100.

As illustrated in FIGS. 21 and 23, the detachable cover 320 may include a cover body 321, a hub 322, a protruding rib 323, a first protrusion 324, a third protrusion 326, and a fourth protrusion 327.

In the coupled state, the cover body 321 may cover a right side surface of the housing 100. A hole may be formed in the cover body 321 for inflow and outflow of air.

An edge portion of the cover body 321 may have an outline that is similar to the profile of the right side surface of the housing 100. The edge portion of the cover body 321 may protrude towards an edge of the right side surface of the housing 100. In the coupled state, the edge portion of the cover body 321 may come into close contact with the edge of the right side surface of the housing 100.

The hub 322 may be a portion to which the fixing shaft (A) is coupled. The fixing shaft (A) may be inserted into a mold when the detachable cover 320 is injection-molded. The hub 322 may be formed on an inner surface of the detachable cover 320. Here, the inner surface of the detachable cover 320 may be a surface that faces the housing 100.

The protruding rib 323 may be a portion that allows the first protrusion 324 to be spaced apart from the inner surface of the detachable cover 320 by a certain distance. The protruding rib 323 may be formed on the inner surface of the detachable cover 320. The protruding rib 323 may be formed in a circumferential direction of the hub 322.

A plurality of first protrusions 324 may be formed in the protruding rib 323. The first protrusions 324 may protrude from the protruding rib 323 towards the hub 322. The first protrusions 324 may be spaced apart from each other in a circumferential direction of the fixing shaft (A).

The first protrusions 324 may be spaced apart from the inner surface of the detachable cover 320 by a certain distance by means of the protruding rib 323. The first protrusions 324 may be guided to the outer surface of the guide rail 112 and rotate in the first rotational direction and the second rotational direction.

The third protrusion 326 may be formed on an edge of the inner surface of the detachable cover 320. When the detachable cover 320 is detachably coupled to the housing 100, the third protrusion 326 may be caught by the first blocking portion 141C. The third protrusion 326 may be spaced farther apart from the fixing shaft (A), compared to the first protrusion 324.

The third protrusion 326, along with an inclined surface 326A, may form a catching surface 326B. When the detachable cover 320 is rotated about the fixing shaft (A), the first blocking portion 141C may interfere with rotation of third protrusion 326.

When the detachable cover 320 is rotated in the first rotational direction, the inclined surface 326A may form a gentle inclination which pushes the first blocking portion 141C towards the central axis of the rotating brush 310. The first blocking portion 141C may be pushed only towards the central axis. Accordingly, when the detachable cover 320 is rotated in the first rotational direction, the first blocking portion 141C may be pushed by the catching surface 326B.

When the detachable cover 320 is rotated in the second rotational direction in the coupled state, the catching surface 326B may form a surface that pushes the first blocking portion 141C in a direction that is approximately perpendicular to the central axis. The first blocking portion 141C may be pushed only towards the central axis. Accordingly, when the detachable cover 320 is rotated in the second rotational direction in the coupled state, the first blocking portion 141C may not be pushed.

In order to rotate the detachable cover 320 in the second rotational direction in the coupled state, the user should push the pressing button 141 in such a manner that the first blocking portion 141C deviates from the rotational route of the third protrusion 326.

A fourth protrusion 327 may be formed on an edge of the inner surface of the detachable cover 320. The fourth protrusion 327 may be positioned further forward in the first rotational direction than the third protrusion 326. In the coupled state, axial-directional movement of the fourth protrusion 327 may be blocked by the second blocking portion 141D. In the coupled state, a rotation of the fourth protrusion 327 in the first rotational direction may be blocked by the support housing 140.

Figure 24:
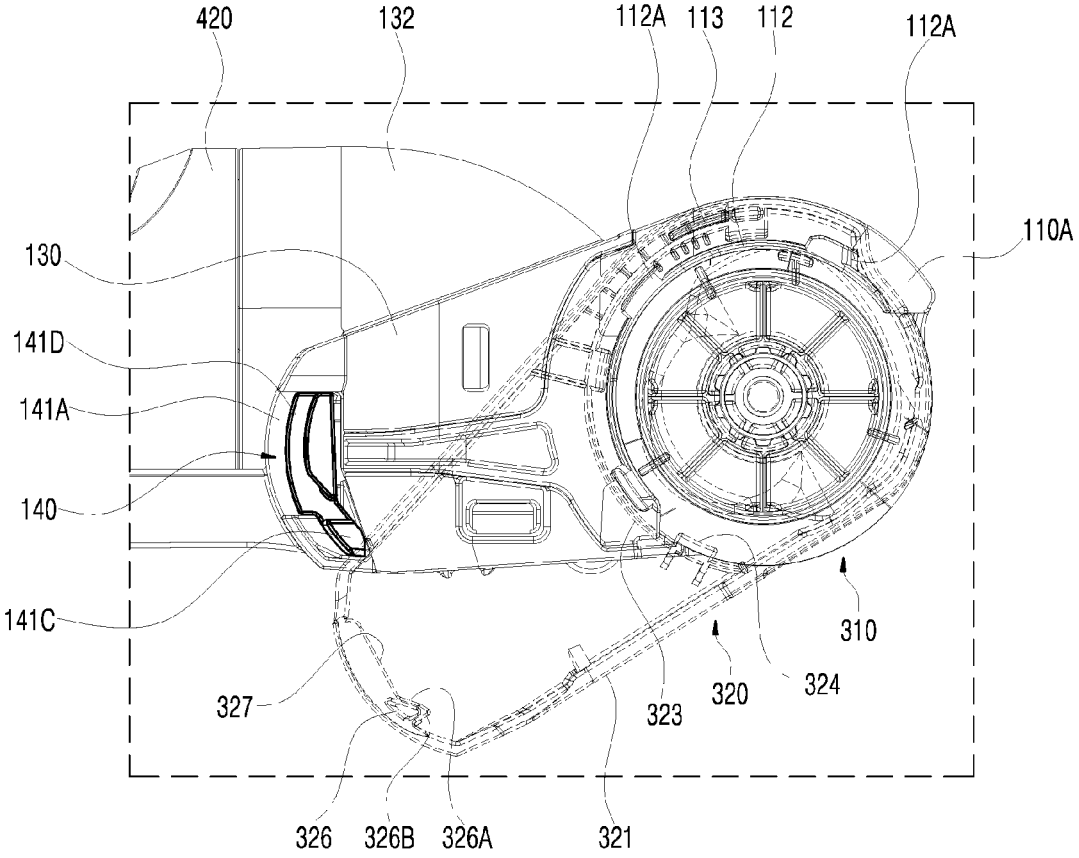
FIG. 24 is a side view of the suction nozzle of FIG. 20.
Figure 25:
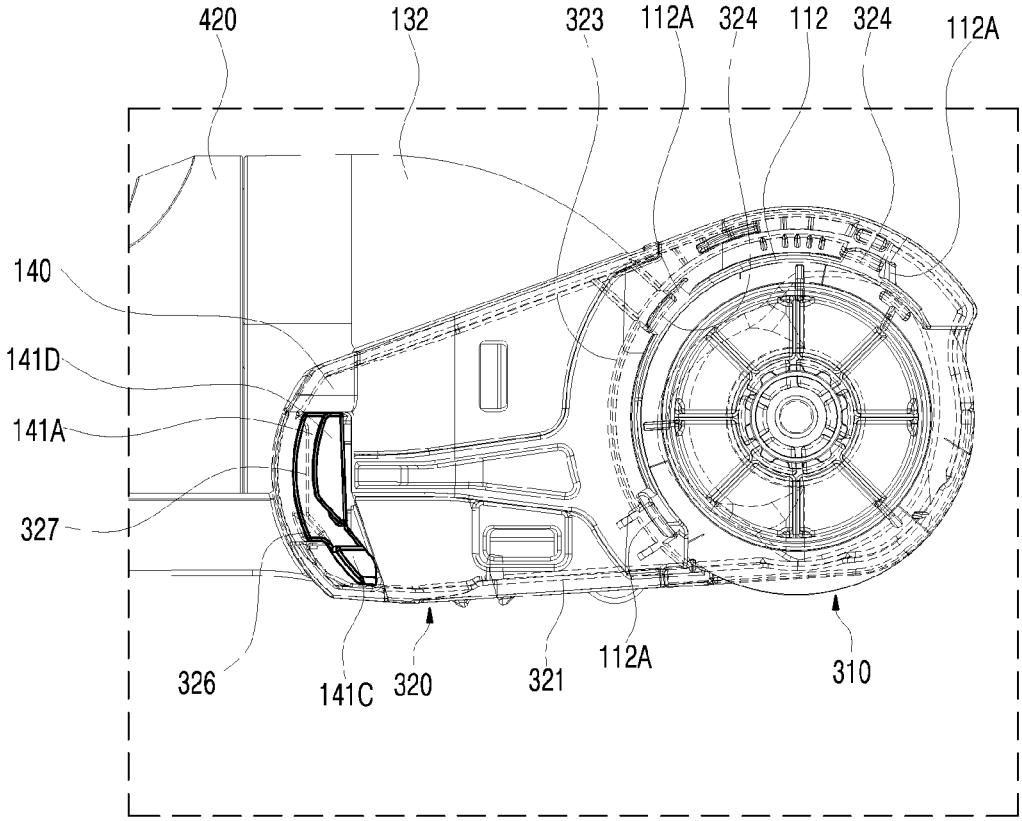
FIG. 25 is a side view of the suction nozzle of FIG. 19 with the pressing button pressed.
Figure 26:
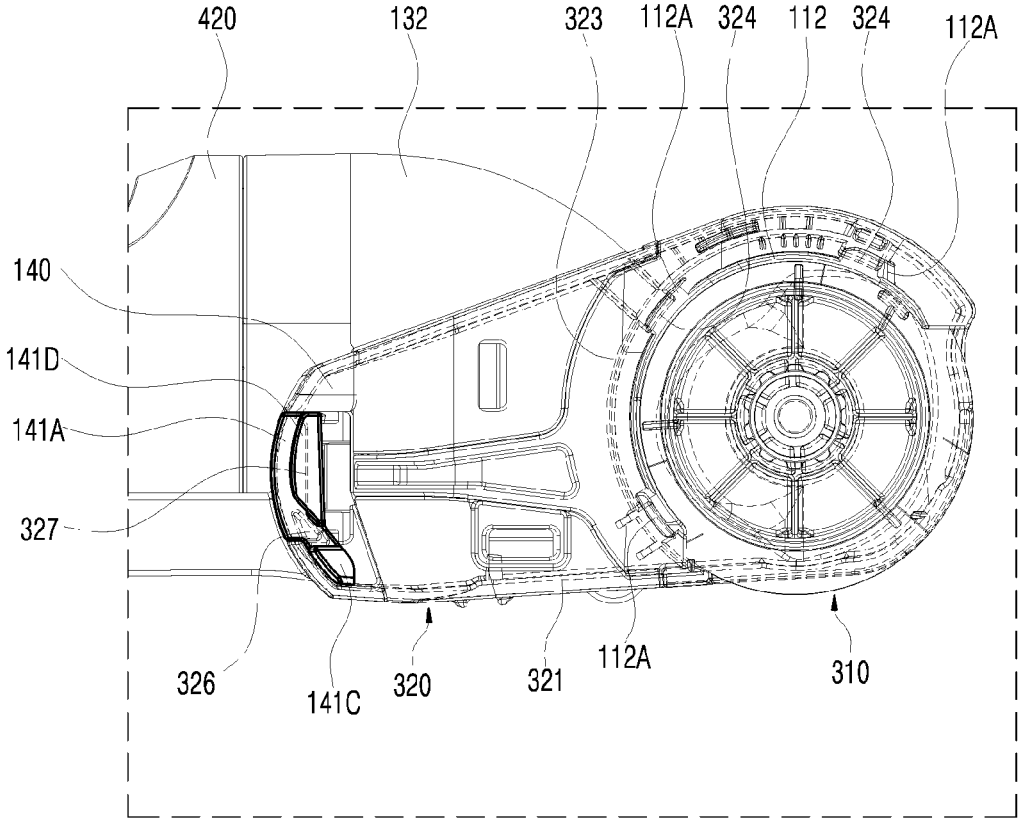
FIG. 26 is a side view of the suction nozzle of FIG. 19.

FIG. 24 is a side view of the suction nozzle 10 of FIG. 20. FIG. 25 is a side view of the suction nozzle 10 of FIG. 19 with the pressing button 141 pressed. FIG. 26 is a side view of the suction nozzle 10 of FIG. 19.

The process of mounting the brush module 300 in the housing 100 is as follows.

First, move the brush module 300 in the axial direction to insert the first shaft member 232D into the second shaft member 313. When the first shaft member 232D is inserted into the second shaft member 313, the detachable cover 320 may be in a state of being decoupled from the housing 100, that is, in the decoupled state described in detail above.

As illustrated in FIG. 24, in the decoupled state, the protruding rib 323 may surround the guide rail 112. In the decoupled state, the second protrusion 113 may be inserted into the guide groove 325.

Thereafter, the user may rotate the detachable cover 320 in the first rotational direction. Then, the first protrusions 324 may be guided to the outer surface of the guide rail 112 to rotate in the first rotational direction. The second protrusion 113 may move inside the guide groove 325 with the rotational axis of the rotating brush 310 as a center.

As illustrated in FIG. 25, in the process in which the detachable cover 320 is rotated in the first rotational direction, the third protrusion 326 may get the first blocking portion 141C to deviate from the rotational route through the inclined surface 326A, and then the third protrusion 326 may keep rotating in the first rotational direction.

As illustrated in FIG. 26, when the fourth protrusion 327 is blocked by the support housing 140, the rotation of the detachable cover 320 in the first rotational direction may be completed. In this state, the detachable cover 320 may be in a state of being coupled to the housing 100, that is, in the coupled state described in detail above.

In the coupled state, the third protrusion 326 may be blocked by the first blocking portion 141C, which blocks a rotation of the third protrusion 326 in the second rotational direction. In the coupled state, an axial-directional movement of the fourth protrusion 327 may be blocked by the second blocking portion 141D.

Here, the first walls 112A may block axial-directional movement of the first protrusions 324. The second walls 112B may block rotation of the first protrusions 324 in the first rotational direction.

The process of separating the brush module 300 from the housing 100 is as follows.

As illustrated in FIG. 25, the user may firstly press the pressing button 141. When the user presses the pressing button 141A, the first blocking portion 141C may deviate from the rotational route of the third protrusion 326.

Here, the user may rotate the detachable cover 320 in the second rotational direction. Then, the third protrusion 326 may rotate in the second rotational direction about the fixing shaft (A) to be spaced apart from the first blocking portion 141C.

The second protrusion 113 may move inside the guide groove 325 with the rotational axis of the rotating brush 310 as a center.

As illustrated in FIG. 24, the first protrusions 324 may be guided to the outer surface of the guide rail 112 to rotate in the second rotational direction. The first protrusions 324 may rotate in the second rotational direction to deviate from between the main housing 110 and the first walls 112A. In this state, the detachable cover 320 may be in a state of being decoupled from the housing 100, that is, in the decoupled state described in detail above.

In the vacuum cleaner of related art 1, a coupling force between the side surface cover and the main body is generated by means of a locking structure such as a hook. Such a coupling structure as a locking structure is a relatively simple structure. However, in a locking structure, when the direction of the suction nozzle is changed, it is difficult to stably support an axial-directional force applied to a rotating cleaning unit.

In the vacuum cleaner 1 of the present disclosure, when the detachable cover 320 is rotated in the second rotational direction while pressing the pressing button 141, the housing 100 and the detachable cover 320 may be easily decoupled. In addition, in the decoupled state, when the detachable cover 320 is rotated in the first rotational direction, a coupling force may be generated between the housing 100 and the detachable cover 320.

Furthermore, in the coupled state, the first walls 112A may block the axial-directional movement of the first protrusions 324. The first walls 112A may be spaced apart from each other in the circumferential direction of the fixing shaft (A).

The first walls 112A, disposed along the circumferential direction of the fixing shaft (A), may disperse and support the axial-directional force that is applied to the rotating brush 310 when the direction of the suction nozzle 10 is changed.

The axial-directional movement of the fourth protrusion 327 may be blocked by the second blocking portion 141D. In addition, in the coupled state, the second walls 112B may block rotation of the first protrusions 324 in the first rotational direction.

The third protrusion 326 may be blocked by the first blocking portion 141C, which blocks a rotation of the third protrusion 326 in the second rotational direction. The rotation of the fourth protrusion 327 may be blocked by the support housing 140, which blocks a rotation of the fourth protrusion 327 in the first rotational direction.

That is, without pressing the pressing button 141, the detachable cover 320 cannot be moved in the axial direction or rotated about the fixing shaft (A). The vacuum cleaner 1 of the present disclosure may form a strong coupling structure in which the housing 100 and the detachable cover 320 cannot easily be decoupled by an external force without pressing the pressing button 141.

Figure 27:
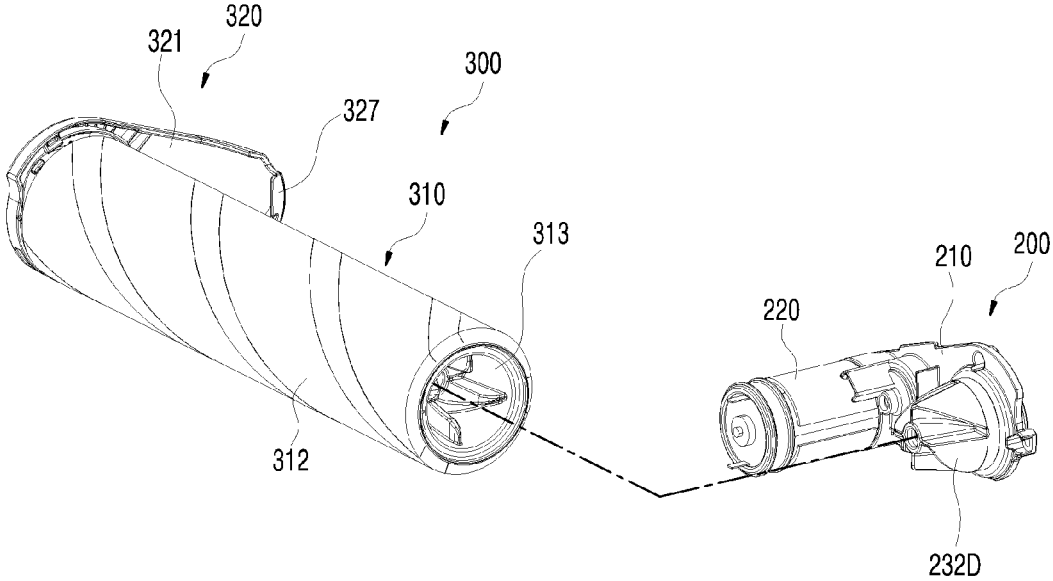
FIG. 27 is a perspective view of the brush module and the driver of the suction module of FIG. 19.
Figure 28:
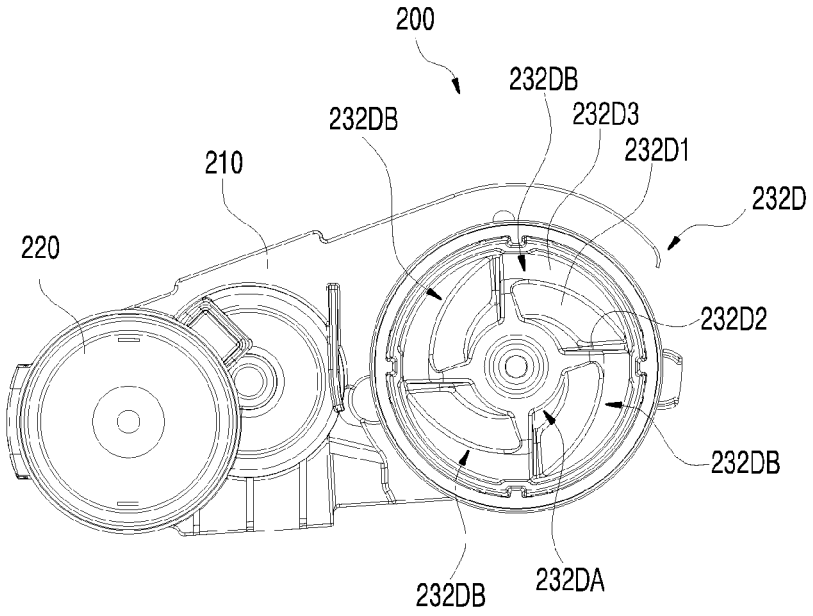
FIG. 28 is a side view of the driver of FIG. 27.
Figure 29:
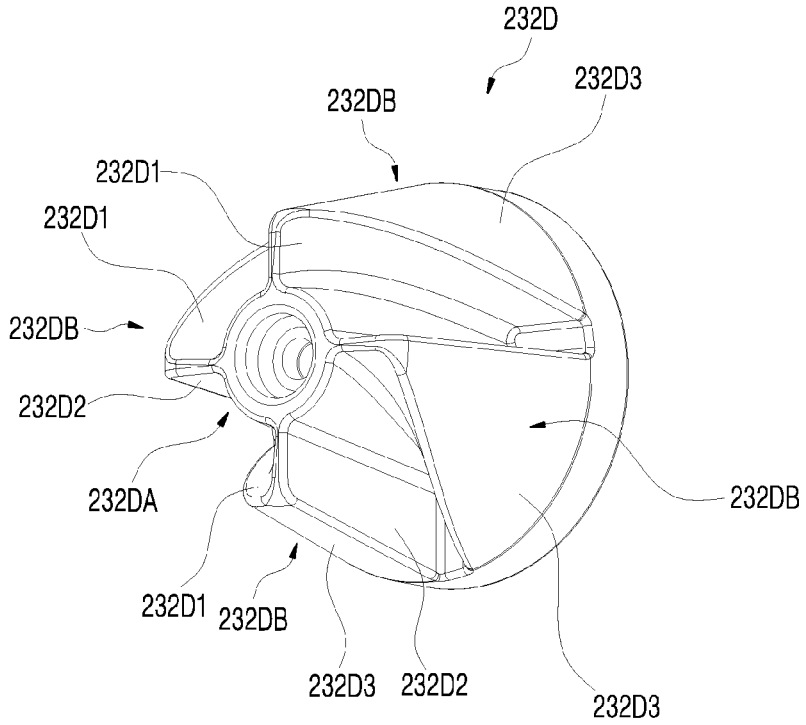
FIG. 29 is a perspective view of a first shaft member of FIG. 28.

FIG. 27 is a perspective view of the brush module 300 and the driver 200 of the suction module 10 of FIG. 19. FIG. 28 is a side view of the driver 200 of FIG. 27. FIG. 29 is a perspective view of the first shaft member 232D of FIG. 28.

Hereinafter, for easy understanding of the present disclosure, an axial direction in which the rotating brush 310 moves so that the first shaft member 232D is inserted into the second shaft member 313 will be referred to as a "first axial direction." Also, the opposite direction to the first axial direction will be referred to as a "second axial direction."

The first shaft member 232D may transfer rotational motion to the second shaft member 313. In the second shaft member 313, a space into which the first shaft member 232D is inserted may be formed.

When the rotating brush 310 moves in the first axial direction, the first shaft member 232D may be inserted into the second shaft member 313. When the first shaft member 232D is inserted into the second shaft member 313, the first shaft member 232D and the second shaft member 313 may engage each other to come into contact with each other on a plurality of contact surfaces.

Rotational motion of the first shaft member 232D may be transferred to the second shaft member 313 through the contact surfaces. With the first shaft member 232D and the second shaft member 313 engaging each other, the rotational axis of the rotating brush 310 and the rotational axis of the first shaft member 232D may be on the same line.

The driver of the vacuum cleaner of related art 1 is coupled to the rotating cleaning unit within the rotating cleaning unit by means of the fixing member. Accordingly, it is difficult to disassemble and reassemble the driver and the rotating cleaning unit in the vacuum cleaner of related art 1.

In the vacuum cleaner 1 of the present disclosure, when the detachable cover 320 is rotated while pressing the pressing button 141 for the decoupled state, the engagement between the first shaft member 232D and the second shaft member 313 may be released. Accordingly, the user may easily decouple the rotating brush 310 and the driver 200 of the vacuum cleaner 1 of the present disclosure.

As illustrated in FIGS. 28 and 29, the first shaft member 232D may include a hub 232DA and a plurality of first transfer portions 232DB.

The hub 232DA may be a portion to which a shaft of the driven pulley 232A (hereinafter referred to as a "pulley shaft") is coupled. The first shaft member 232D may rotate about the hub 232DA.

The first transfer portions 232DB may be axisymmetric with each other about the pulley shaft (PA). The number of the first transfer portions 232DB may be variously determined. For example, the number of the first transfer portions 232DB may be four.

A single first transfer portion 232DB may form three surfaces. A single first transfer portion 232DB may form a first surface 232D1, a third surface 232D2, and a fifth surface 232D3.

First surfaces 232D1 of the first transfer portions 232DB may extend from a side surface of the hub 232DA in an approximately radial direction of the pulley shaft (PA). The first surfaces 232D1 of the first transfer portions 232DB may be surfaces that transfer the rotational motion of the first shaft member 232D to the second shaft member 313. The first surfaces 232D1 may form a relatively small angle with a radial direction of the pulley shaft (PA).

The first surfaces 232D1 may form a spiral around the pulley shaft (PA). The first surfaces 232D1 may be positioned along the rotational direction of the first shaft member 232D towards the first axial direction. The first surfaces 232D1 may be axisymmetric with each other about the hub 232DA.

A surface area of the first surfaces 232D1 may increasingly decrease towards the second axial direction. The first surfaces 232D1 may be positioned increasingly closer to the rotational axis of the rotating brush 310 towards the second axial direction.

Third surfaces 232D2 of the first transfer portions 232DB may extend from a side surface of the hub 232DA in an approximately radial direction of the pulley shaft (PA). The third surfaces 232D2 may form a relatively small angle with the radial direction of the pulley shaft (PA).

The third surfaces 232D2 may be surfaces that receive a rotational inertia of the rotating brush 310. Rotational inertia refers to the property by which a rotating object maintains its state of uniform rotational motion.

The second shaft member 313 may receive the rotational force of the motor 220 through the first shaft member 232D. However, if a rotation speed of the second shaft member 313 is greater than a rotation speed of the first shaft member 232D, the rotational inertia of the rotating brush 310 may be transferred to the first shaft member 232D.

That is, after an operation of the driver 200 stops, the rotational inertia of the rotating brush 310 may be transferred to the first shaft member 232D through the second shaft member 313 until the rotation of the rotating brush 310 stops.

Or, if the rotation speed of the rotating brush 310 is adjusted, the rotational inertia of the rotating brush 310 may be transferred to the first shaft member 232D through the second shaft member 313 in the process where a rotation speed of the motor 220 decreases.

The third surfaces 232D2 may form a plane aligned with the axial direction of the rotating brush 310. The third surfaces 232D2 may be axisymmetric with each other about the pulley shaft (PA).

The surface area of the third surfaces 232D2 may increasingly decrease towards the second axial direction. The third surfaces 232D2 may be positioned increasingly closer to the rotational axis of the rotating brush 310 towards the second axial direction.

When the first shaft member 232D is inserted into the second shaft member 313, a single second transfer portion 313B may be inserted between a first surface 232D1 and a third surface 232D2 that are adjacent to each other.

The fifth surface 232D3 may be a surface connecting the first surface 232D1 and the third surface 232D2. The fifth surface 232D3 may connect the first surface 232D1 and the third surface 232D2 in a circumferential direction of the pulley shaft (PA). Fifth surfaces 232D3 of the first transfer portions 232DB may be axisymmetric with each other about the pulley shaft (PA).

The surface area of the fifth surfaces 232D3 may increasingly decrease towards the second axial direction. The fifth surfaces 232D3 may be positioned increasingly closer to the rotational axis of the rotating brush 310 towards the second axial direction.

Figure 30:
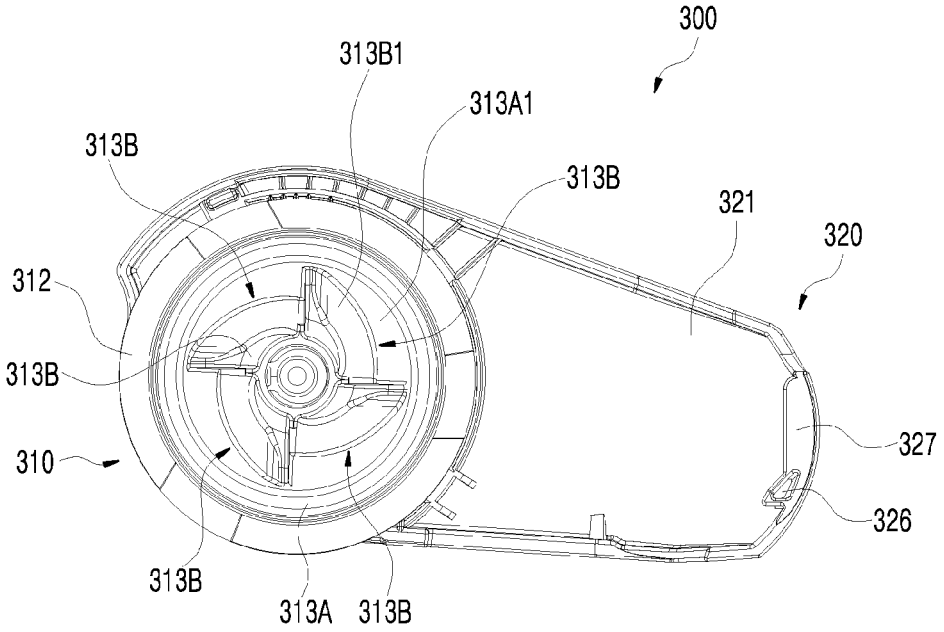
FIG. 30 is a side view of the brush module of FIG. 27.
Figure 31:
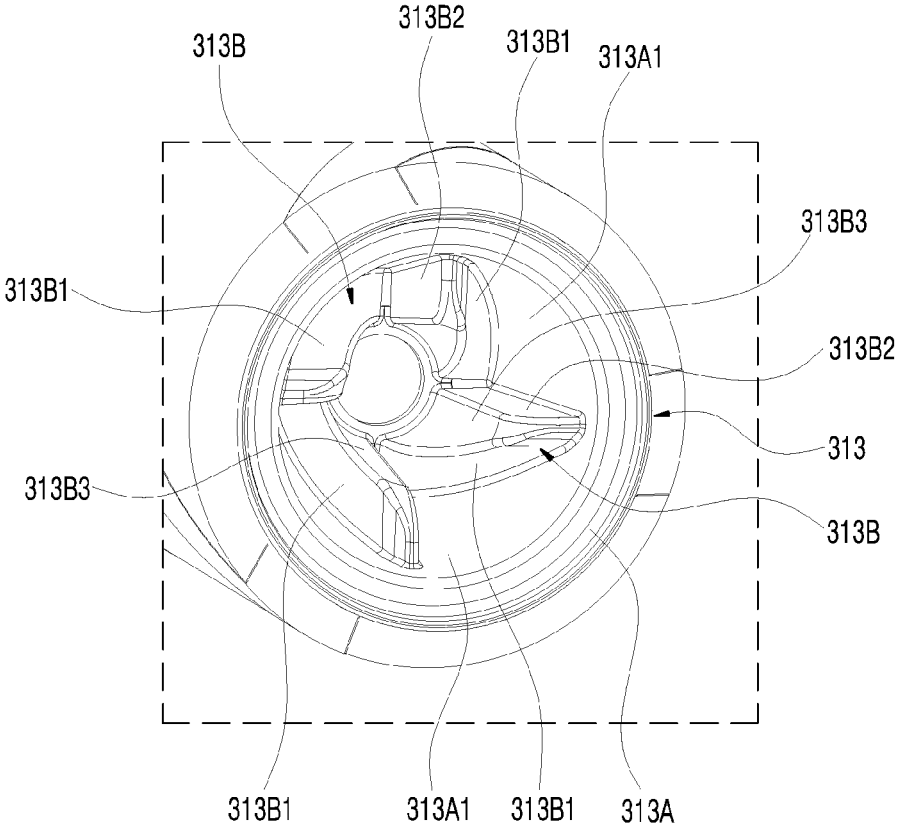
FIG. 31 is a partial perspective view of a second shaft member of FIG. 30.

FIG. 30 is a side view of the brush module 300 of FIG. 27. FIG. 31 is a partial perspective view of the second shaft member 313 of FIG. 30.

As illustrated in FIGS. 30 and 31, the second shaft member 313 may include a shaft body 313A and a plurality of second transfer portions 313B.

The shaft body 313A may be inserted into an opening at one side of the body 311. An insertion groove 313H may be formed on an outer surface of the shaft body 313A. A protruding portion 311A may be formed along the length direction of an inner surface of the body 311.

When the shaft body 313A is inserted into the opening of the body 311, the protruding portion 311A may be inserted into the insertion groove 313H. The protruding portion 311A may block relative rotation of the shaft body 313A.

The second transfer portions 313B may be axisymmetric with each other about the pulley shaft (PA). When the first shaft member 232D is inserted into the second shaft member 313, the first shaft member 232D and the second shaft member 313 may engage each other to come into contact with each other on a plurality of contact surfaces. Accordingly, the number of the second transfer portions 313B may be equal to the number of the first transfer portions 232DB.

A single second transfer portion 313B may form three surfaces. A single second transfer portion 313B may form a second surface 313B1, a fourth surface 313B2, and a seventh surface 313B3. The shaft body 313A may form a sixth surface 313A1.

Second surfaces 313B1 of the second transfer portions 232DB may extend from an inner surface of the shaft body 313A in an approximately radial direction of the pulley shaft (PA). The second surfaces 313B1 may form a relatively small angle with the radial direction of the pulley shaft (PA).

The second surfaces 313B1 may form a spiral around the pulley shaft (PA). The second surfaces 313B1 may be positioned along the rotational direction of the first shaft member 232D towards the first axial direction.

The second surfaces 313B1 may be axisymmetric with each other about the shaft body 313A. The second surfaces 313B1 may be positioned increasingly closer to the rotational axis of the rotating brush 310 towards the second axial direction.

Figure 32:
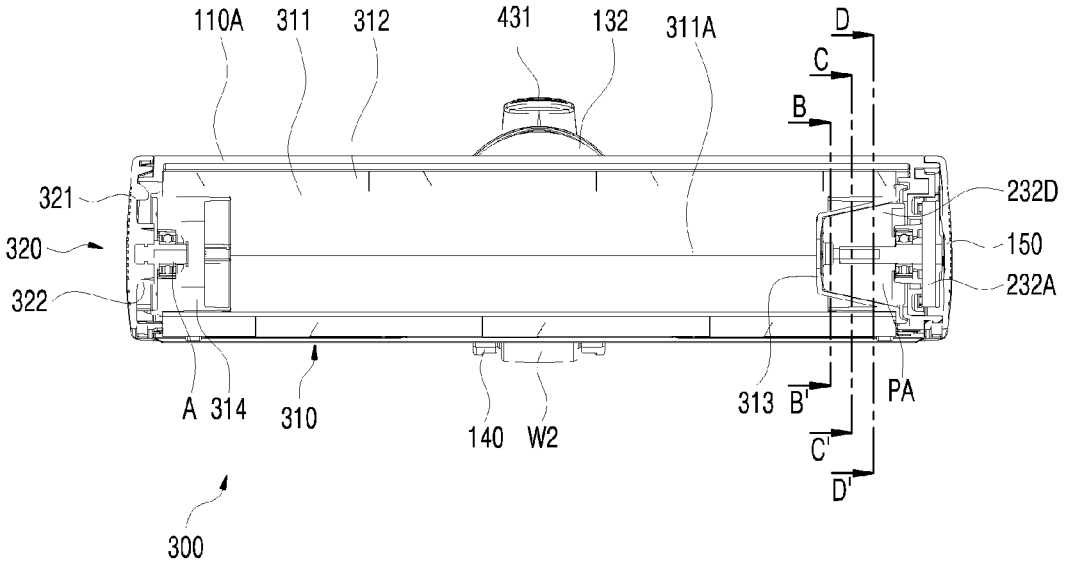
FIG. 32 is a cross-sectional view of the suction module of FIG. 19.
Figure 33:
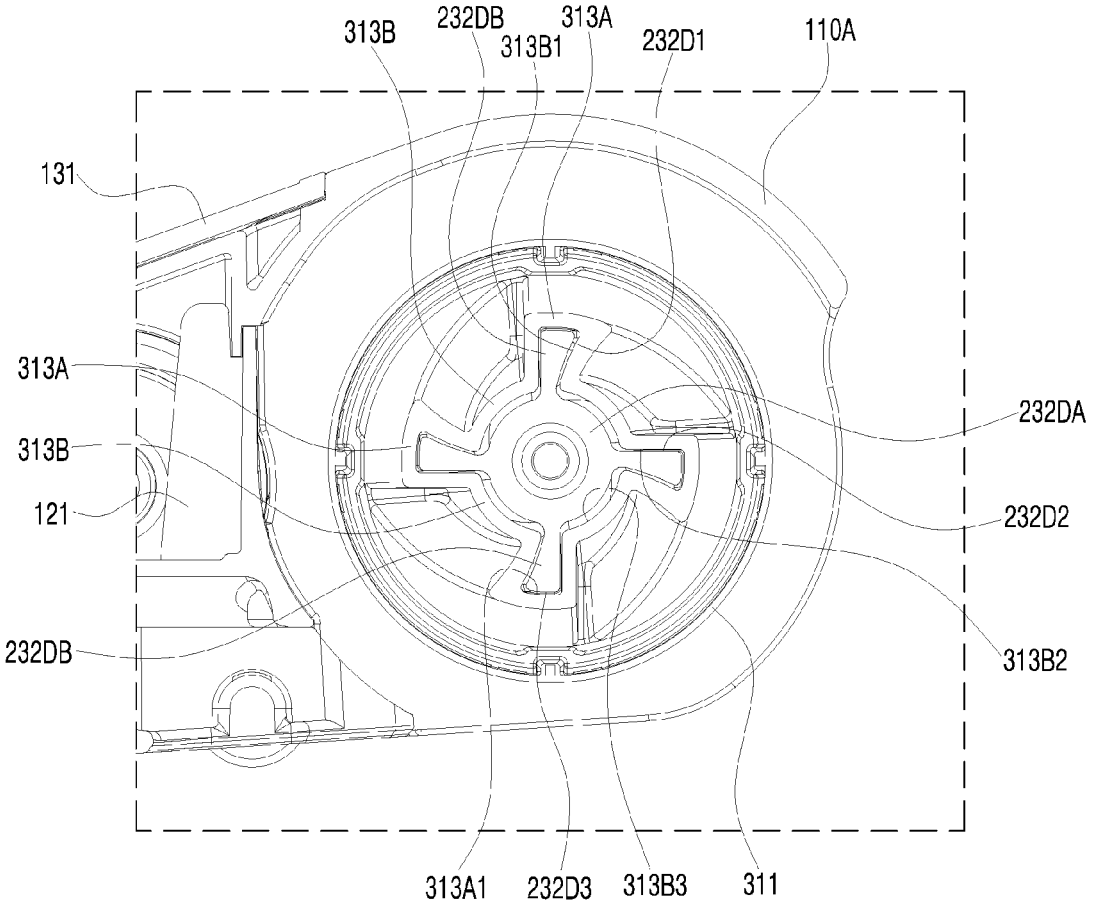
FIG. 33 is a cross-sectional view of the suction module of FIG. 32 when the suction module is cut along the line from B to B'.
Figure 34:
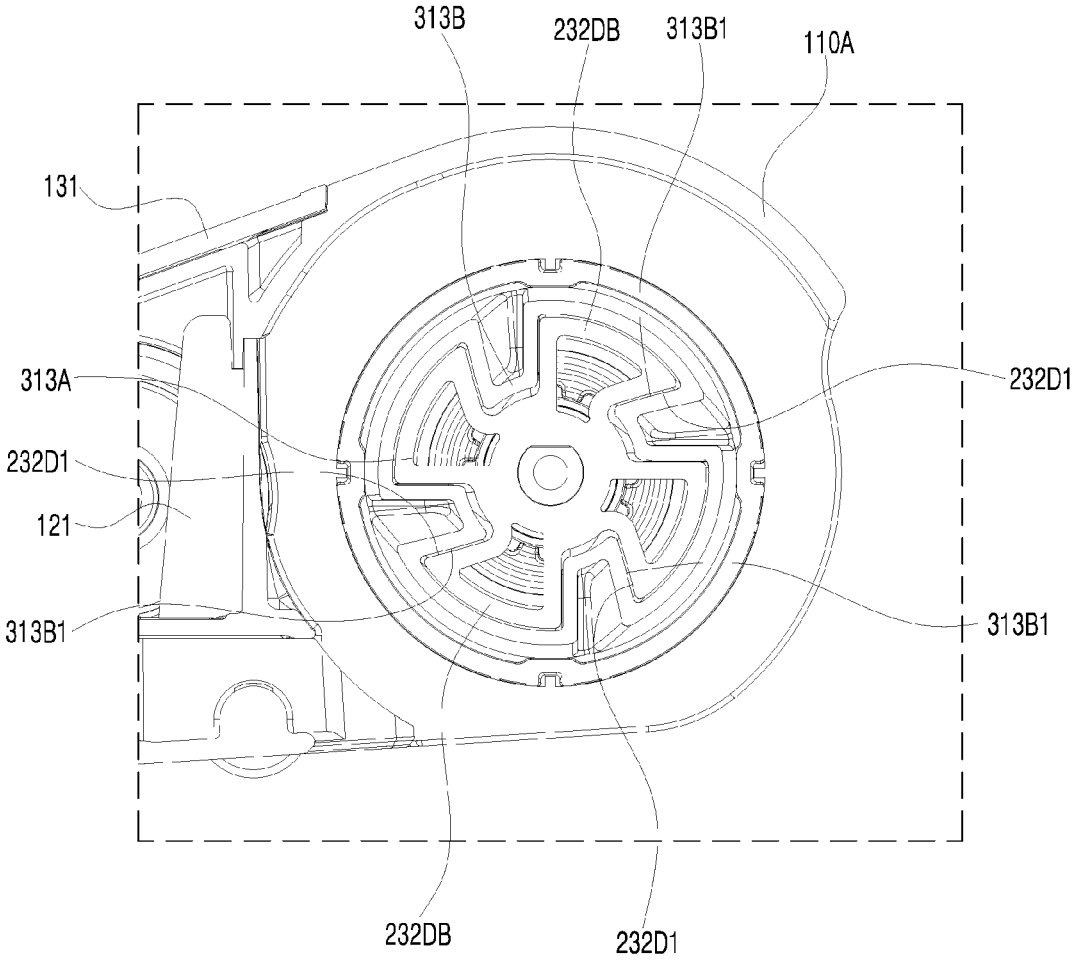
FIG. 34 is a cross-sectional view of the suction module of FIG. 32 when the suction module is cut along the line from C to C'.
Figure 35:
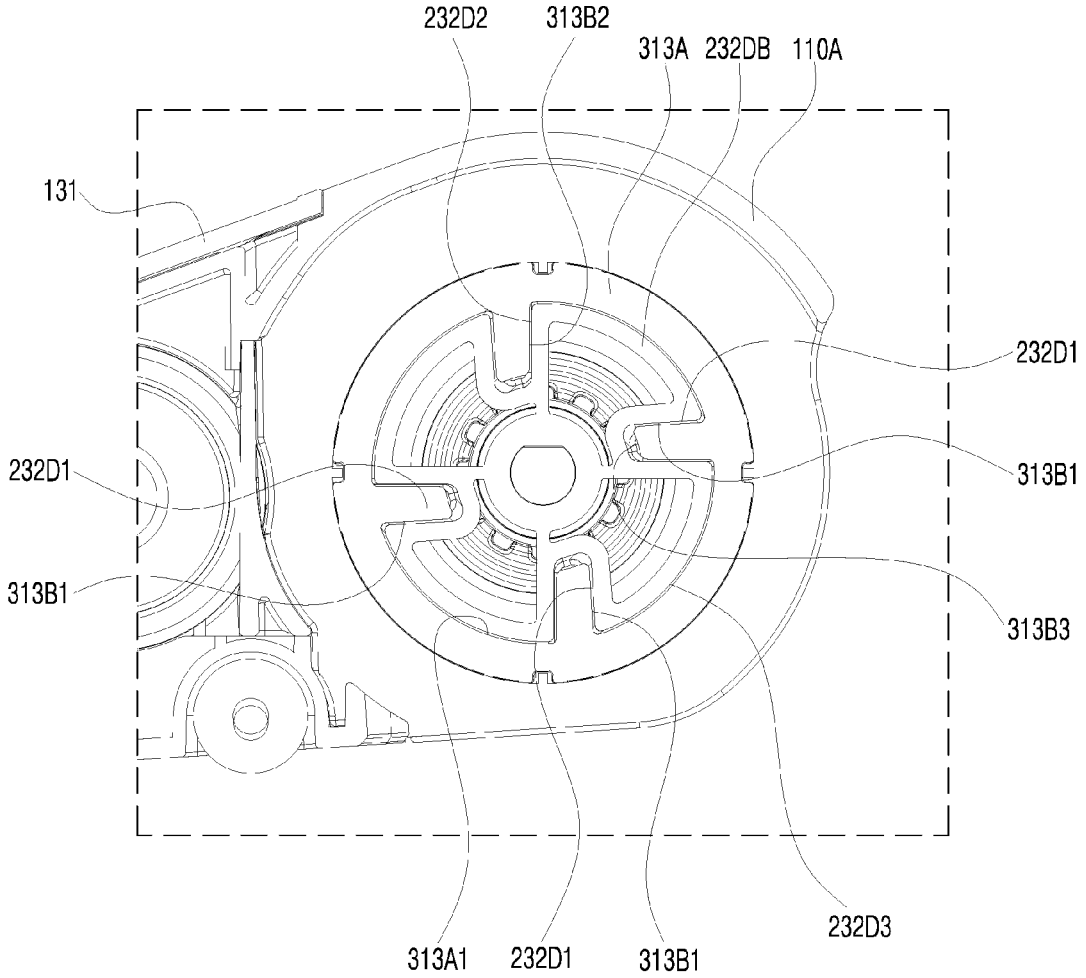
FIG. 35 is a cross-sectional view of the suction module of FIG. 32 when the suction module is cut along the line from D to D'.

FIG. 32 is a cross-sectional view of the suction module 10 of FIG. 19. FIG. 33 is a cross-sectional view of the suction module 10 of FIG. 32 when the suction module 10 is cut along the line from B to B'. FIG. 34 is a cross-sectional view of the suction module 10 of FIG. 32 when the suction module 10 is cut along the line from C to C'. FIG. 35 is a cross-sectional view of the suction module 10 of FIG. 32 when the suction module 10 is cut along the line from D to D'.

The second surfaces 313B1 may be surfaces receiving the rotational force of the first shaft member 232D. When the first shaft member 232D is inserted into the second shaft member 313, the second surfaces 313B1 and the first surfaces 232D1 may form first contact surfaces helically along the axial direction. On the helical first contact surfaces, the rotational force of the first shaft member 232D may be transferred to the second shaft member 313.

The first contact surfaces may be axisymmetric with each other about the rotational axis of the rotating brush 310. The first contact surfaces may be positioned along the rotational direction of the first shaft member 232D towards the first axial direction.

Figure 36:
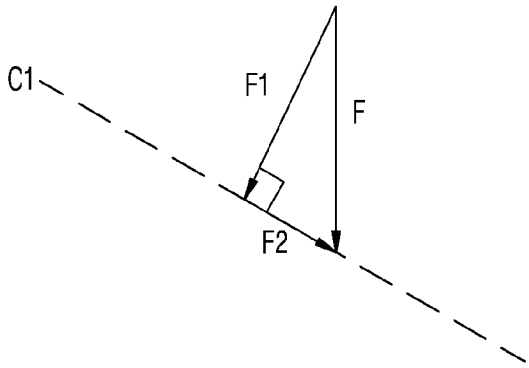
FIG. 36 is a drawing illustrating a force acting on a first contact surface.
Figure 37:
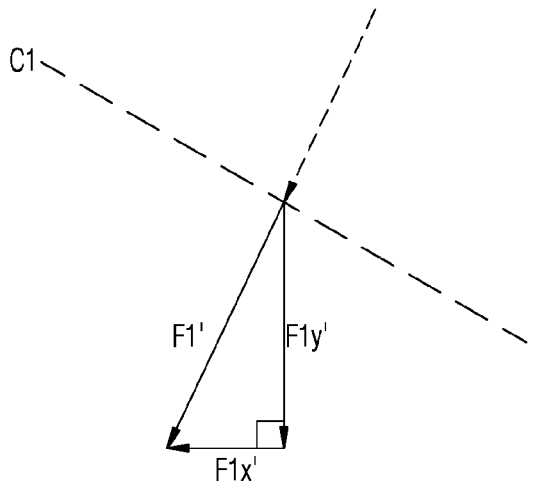
FIG. 37 is a drawing illustrating a force transferred to a second surface.

FIG. 36 is a drawing illustrating a force acting on a first contact surface (C1). FIG. 37 is a drawing illustrating a force acting on the second surface 313B1.

A rotational force (F) of the first shaft member 232D that is applied to the second surface 313B1 through the first contact surface (C1) may be divided into a force (F2; hereinafter referred to as a "friction component force") in parallel with the first contact surface (C1) and a force (F1; hereinafter referred to as an "action force") in the normal direction of the first contact surface (C1).

The first surface 232D1 and the second surface 313B1 may be smooth surfaces. That is, the frictional coefficient of the first contact surface (C1) may be relatively very small.

Accordingly, it can be assumed that the friction component force (F2) may be very small compared to the action force (F1). Accordingly, the first surfaces 232D1 and the second surfaces 313B1 may slip on the first contact surfaces (C1) due to the rotational force of the first shaft member 232D.

Thus, in general, the action force (F1) may act on the second surface 313B1 through the first contact surface (C1). An action force (F1') that is transferred to the second surface 313B1 through the first contact surface (C1) may be divided into an axial-directional component force (F1*x*'; hereinafter referred to as a "movement component force") and a component force in the same direction as the rotational force of the first shaft member 232D (F1*y*'; hereinafter referred to as a "rotation component force").

The rotating brush 310 may be rotated by the rotation component force (Fly'). Also, the rotating brush 310 may be pushed in the second axial direction by the movement component force (F1*x*'). The ratio of the movement component force (F1*x*') to the rotation component force (F1*y*') varies depending on a lead of the first contact surface (C1). The lead of the first contact surface (C1) may be equal to a lead of the first surface 232D1 and the second surface 313B1.

The vacuum cleaner of related art 1 has a deficiency in that when the vacuum cleaner is used, the rotating cleaning unit moves in the axial direction thereof due to the reaction force and the friction force of the floor. The axial-directional movement of the rotating cleaning unit may cause noise on contact surfaces between the rotating cleaning unit and the rotating support unit and among the first side surface cover and the second side surface cover and the chamber. In addition, the axial-directional movement of the rotating cleaning unit may cause damage to the coupling structure of the first side surface cover, the second side surface cover, and the chamber.

The vacuum cleaner 1 of the present disclosure, by contrast, may have an advantage in that as the rotating brush 310 is continuously pushed in the second axial direction by the movement component force (F1*x*'), axial-directional movement of the rotating brush 310 can be prevented even when the reaction force and the friction force of the floor are applied in the axial direction.

A surface area of the first surfaces 232D1 may increasingly decrease towards the second axial direction. Accordingly, a surface area of the first contact surface may increasingly decrease towards the second axial direction.

The first surfaces 232D1 and the second surfaces 313B1 may be positioned increasingly closer to the rotational axis of the rotating brush 310 towards the second axial direction. Accordingly, the first contact surfaces may be positioned increasingly closer to the rotational axis of the rotating brush 310 towards the second axial direction.

Thus, as a distance by which the rotating brush 310 is pushed in the second axial direction increases, the movement component force (F1*x*') that is transferred to the second surfaces 313B1 through the first contact surface (C1) may decrease. Accordingly, a phenomenon in which the rotating brush 310 is excessively pushed in the second axial direction by the movement component force (F1*x*') may be prevented.

Fourth surfaces 313B2 of the second transfer portions 232DB may extend from a side surface of the shaft body 313A in an approximately radial direction of the pulley shaft (PA). The fourth surfaces 313B2 may form a relatively small angle with the radial direction of the pulley shaft (PA).

The fourth surfaces 313B2 may be axisymmetric with each other about the pulley shaft (PA). The fourth surfaces 313B2 may be positioned increasingly closer to the rotational axis of the rotating brush 310 towards the second axial direction.

The fourth surfaces 313B2 may form a plane aligned with the axial direction of the rotating brush 310. When the first shaft member 232D pushes the second shaft member 313 in the second axial direction on the first contact surfaces formed in the spiral shape, the first shaft member 232D and the second shaft member 313 may be spaced apart in the axial direction while maintaining the first contact surfaces.

The first surfaces 232D1 and the second surfaces 313B1 may be positioned along the rotational direction of the first shaft member 232D towards the first axial direction. That is, with a single first transfer portion 232DB as a center, the first surface 232D1 and the third surface 232D2 may get closer to each other towards the second axial direction.

In addition, with a single second transfer portion 313B as a center, the second surface 313B1 and the fourth surface 313B2 may get closer to each other towards the second axial direction.

Accordingly, when the first shaft member 232D pushes the second shaft member 313 in the second axial direction through the first contact surface, the third surface 232D2 and the fourth surface 313B2 may be spaced apart from each other. That is, when the first shaft member 232D pushes the second shaft member 313 in the second axial direction through the first contact surface, the fourth surfaces and the third surfaces may not come into contact with each other on the second contact surfaces.

The fourth surfaces 313B2 may be surfaces which transfer the rotational inertia of the rotating brush 310 to the first shaft member 232D. When the first shaft member 232D is inserted into the second shaft member 313, the fourth surfaces and the third surfaces 232D2 may form a plurality of second contact surfaces aligned with the axial direction. The second contact surfaces may be axisymmetric with each other about the rotational axis of the rotating brush 310.

Figure 38:
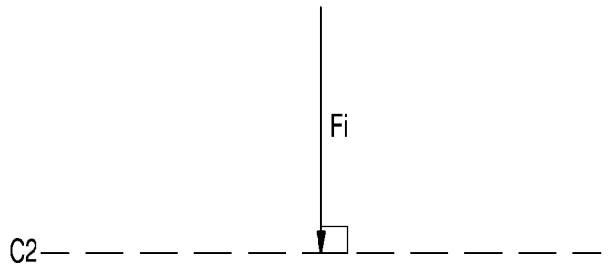
FIG. 38 is a drawing illustrating a force acting on a second contact surface.

FIG. 38 is a drawing illustrating a force acting on a second contact surface (C2).

After an operation of the driver 200 stops, the rotational inertia (Fi) of the rotating brush 310 may be transferred to the first shaft member 232D through the second contact surfaces (C2) until rotation of the rotating brush 310 stops. Or, while a rotational speed of the motor 220 decreases, the rotational inertia (Fi) of the rotating brush 310 may be transferred to the first shaft member 232D through the second contact surfaces C2.

The rotational inertia (Fi) of the rotating brush 310 may be transferred to the first shaft member 232D until the second shaft member 313 rotates at the same speed as that of the first shaft member 232D or stops. A rotational force of the second shaft member 313 that is applied to the third surface 232D2 through the second contact surface (C2) may act on the third surface 232D2 in a perpendicular direction.

Accordingly, until the second shaft member 313 rotates at the same speed as that of the first shaft member 232D or stops, the first shaft member 232D and the second shaft member 313 may stably maintain contact on the second contact surface.

Thus, relative movement of the first shaft member 232D and the second shaft member 313, which is caused by an external force transferred in the radial direction of the pulley shaft (PA) in the process in which the rotational speed of the motor 220 decreases, may be minimized.

When the first shaft member 232D is inserted into the second shaft member 313, the sixth surface 313A1 and the fifth surfaces 232D3 may form a contact surface. The sixth surface 313A1 and the fifth surface 232D3 may act as a boundary surface for blocking relative movement of the first shaft member 232D and the second shaft member 313 caused by an external force transferred in the radial direction of the pulley shaft (PA).

The seventh surface 313B3 may be a surface connecting the second surface 313B1 and the fourth surface 313B2. The seventh surface 313B3 may connect the second surface 313B1 and the fourth surface 313B2 in a circumferential direction of the pulley shaft (PA). Seventh surfaces 313B3 of the second transfer portions 232DB may be axisymmetric with each other about the pulley shaft (PA).

The seventh surfaces 313B3 may be positioned increasingly closer to the rotational axis of the rotating brush 310 towards the second axial direction. When all the contact surfaces between the first shaft member 232D and the second shaft member 313 come into close contact with each other, the first shaft member 232D may be inserted into the second shaft member 313. With the first shaft member 232D being inserted into the second shaft member 313, the seventh surfaces 313B3 may be spaced apart from the hub 232DA.

While the foregoing has been given by way of illustrative example of the present disclosure, all such and other modifications and variations thereto as would be apparent to those skilled in the art are deemed to fall within the broad scope and ambit of this disclosure as is herein set forth. Accordingly, such modifications or variations are not to be regarded as a departure from the spirit or scope of the present disclosure, and it is intended that the present disclosure cover the modifications and variations of this invention provided they come within the scope of the appended claims and their equivalents.

INDUSTRIAL APPLICABILITY

According to the vacuum cleaner of the present disclosure, when the first protrusions are rotated about the rotational axis of the rotating brush along the guide rail, the first walls may block movement of the first protrusions in the direction of the rotational axis, and the first blocking portion, which extends from the button portion, may block rotation of the third protrusion about the rotational axis, such that the housing and the detachable cover can be coupled to or decoupled from each other by means of the rotation of the detachable cover. In this regard, the vacuum cleaner of the present disclosure overcomes the limits of existing technology, and there is thus sufficient possibility not only of the use of the related technology but also of the actual sale of apparatuses to which the related technology is applied. In addition, the present disclosure can be obviously and practically implemented by those skilled in the art. Therefore, the present disclosure is industrially applicable.

What is claimed is:

1. A vacuum cleaner comprising:

a suction nozzle configured to suction dust from a floor; and a main body configured to receive the dust, wherein the suction nozzle comprises:

a housing that defines an inlet configured to provide the dust to the main body, a rotating brush disposed at the housing and configured to rotate about a rotational axis, a driver disposed at the housing and configured to rotate the rotating brush, the driver comprising a first shaft member configured to transfer rotational force to the rotating brush, a detachable cover configured to rotatably support the rotating brush, the detachable cover being configured to be detachably coupled to the housing based on being rotated relative to the housing about the rotational axis of the rotating brush, a button disposed at the housing and configured to selectively restrict rotation of the detachable cover relative to the housing, a plurality of first protrusions disposed at the detachable cover, a second protrusion disposed at the housing, and a third protrusion disposed at the detachable cover, wherein the housing comprises a guide rail arranged along a circumferential direction about the rotational axis and configured to guide rotation of the plurality of first protrusions about the rotational axis, wherein the detachable cover includes a guide groove that is defined at an inner surface the detachable cover along the circumferential direction, the guide groove being configured to guide the second protrusion based on the detachable cover being rotated relative to the housing about the rotational axis, wherein the button comprises:

a button portion configured to be pressed by a user, and a first blocking portion that extends from the button portion and is configured to restrict rotation of the detachable cover by blocking a rotational route of the third protrusion based on the detachable cover being rotated relative to the housing about the rotational axis, and wherein the first blocking portion is configured to, based on the user pressing the button portion, deviate from the rotational route of the third protrusion.

2. The vacuum cleaner of claim 1, wherein the suction nozzle further comprises a fourth protrusion disposed at the detachable cover, and wherein the button further comprises a second blocking portion that extends from the button portion and is configured to restrict movement of the fourth protrusion in a direction parallel to the rotational axis.

3. The vacuum cleaner of claim 1, wherein the guide rail comprises a plurality of first walls configured to restrict movement of the plurality of first protrusions in a direction parallel to the rotational axis.

4. The vacuum cleaner of claim 3, wherein the guide rail further comprises a plurality of second walls configured to restrict rotation of the plurality of first protrusions about the rotational axis.

5. The vacuum cleaner of claim 1, wherein the button further comprises an elastic member disposed between the button portion and the housing and configured to apply force to the button portion to thereby replace the first blocking portion to the rotational route of the third protrusion based on the user releasing the button portion.

6. The vacuum cleaner of claim 1, wherein the rotating brush comprises:

a brush body having a cylindrical shape, the brush body defining an opening at a side thereof;

a brush member attached to an outer circumferential surface of the brush body and configured to contact the floor; and a second shaft member disposed in the opening of the brush body and configured to engage with the first shaft member.

7. The vacuum cleaner of claim 1, wherein the driver further comprises a motor coupled to the housing and configured to generate the rotational force.

8. The vacuum cleaner of claim 7, wherein the motor and the first shaft member are disposed at a first side of the housing, and wherein the detachable cover is configured to be coupled to a second side of the housing opposite the first side of the housing.

9. A vacuum cleaner comprising:

a suction nozzle configured to suction dust from a floor, the suction nozzle comprising:

a housing configured to move along the floor, a rotating brush disposed at the housing and configured to rotate about a rotational axis, a driver disposed at the housing and configured to rotate the rotating brush, a detachable cover configured to rotatably support the rotating brush, the detachable cover being configured to be detachably coupled to the housing based on being rotated relative to the housing about the rotational axis of the rotating brush, a button disposed at the housing and configured to selectively restrict rotation of the detachable cover relative to the housing, a plurality of first protrusions disposed at the detachable cover, and a second protrusion disposed at the housing, wherein the housing comprises a guide rail arranged along a circumferential direction about the rotational axis and configured to guide rotation of the plurality of first protrusions about the rotational axis, wherein the detachable cover includes a guide groove that is defined at an inner surface the detachable cover along the circumferential direction, the guide groove being configured to guide the second protrusion based on the detachable cover being rotated relative to the housing about the rotational axis, wherein the detachable cover comprises a third protrusion that protrudes from the inner surface of the detachable cover and configured to interfere with at least a portion of the button, wherein the button comprises:

a button portion configured to be pressed by a user, and a first blocking portion that extends from the button portion and is configured to restrict rotation of the detachable cover by blocking a rotational route of the third protrusion of the detachable cover based on the detachable cover being rotated relative to the housing about the rotational axis, wherein the first blocking portion is configured to, based on the user pressing the button portion, deviate from the rotational route of the third protrusion of the detachable cover.

10. The vacuum cleaner of claim 9, wherein the button further comprises an elastic member disposed between the button portion and the housing and configured to apply force to the button portion to thereby replace the blocking portion to the rotational route of the third protrusion based on the user releasing the button portion.

11. The vacuum cleaner of claim 9, wherein the housing comprises a plurality of first walls that radially protrude from a circumferential surface of an end portion of the housing and are arranged along the circumferential surface of the housing, the plurality of first walls being configured to guide rotation of the first protrusions about the rotational axis and to restrict movement of the plurality of first protrusions in a direction parallel to the rotational axis.

12. The vacuum cleaner of claim 11, wherein the housing further comprises a second wall that extends from at least one of the plurality of first walls in the direction parallel to the rotational axis and is configured to restrict rotation of the plurality of first protrusions about the rotational axis.

13. The vacuum cleaner of claim 9, wherein the driver comprises:

a motor coupled to the housing and configured to generate rotational force; and a first shaft member configured to transfer the rotational force of the motor to the rotating brush, and wherein the rotating brush comprises a second shaft member coupled at a side of the rotating brush and configured to engage with the first shaft member.

14. The vacuum cleaner of claim 13, wherein the motor, the first shaft member, and the second shaft member are disposed at a first side of the housing, and wherein the detachable cover is configured to be coupled to a second side of the housing opposite the first side of the housing.

15. The vacuum cleaner of claim 13, wherein the first shaft member and the second shaft member are disposed along the rotational axis of the rotating brush.

* * * * *